US007172196B2

(12) United States Patent
Randall

(10) Patent No.: US 7,172,196 B2
(45) Date of Patent: Feb. 6, 2007

(54) SYSTEMS AND METHODS FOR PROVIDING ELECTRIC POWER TO MOBILE AND ARBITRARILY POSITIONED DEVICES

(76) Inventor: Mitch Randall, 2630 Hawthorne Pl., Boulder, CO (US) 80304

( * ) Notice: Subject to any disclaimer, the term of this patent is extended or adjusted under 35 U.S.C. 154(b) by 0 days.

(21) Appl. No.: 10/732,103

(22) Filed: Dec. 10, 2003

(65) Prior Publication Data

US 2004/0195767 A1 Oct. 7, 2004

Related U.S. Application Data

(60) Provisional application No. 60/444,826, filed on Feb. 4, 2003, provisional application No. 60/441,794, filed on Jan. 22, 2003, provisional application No. 60/432,072, filed on Dec. 10, 2002.

(51) Int. Cl.
*A63F 3/00* (2006.01)

(52) U.S. Cl. ..... 273/237

(58) Field of Classification Search ..... 273/237–238, 273/242

See application file for complete search history.

(56) References Cited

U.S. PATENT DOCUMENTS 4,616,832 A 10/1986 Groner
5,793,123 A * 8/1998 Ho et al. ..... 307/66
5,890,717 A 4/1999 Rosewarne et al.
2004/0048511 A1 3/2004 Dayan et al.
2004/0082369 A1 * 4/2004 Dayan et al. ..... 455/573

* cited by examiner

*Primary Examiner*—Kim Nguyen
(74) *Attorney, Agent, or Firm*—Cochran Freund & Young LLC; James R. Young

(57) ABSTRACT

Various contact systems and methods for manufacturing and using such are disclosed herein. Examples of the contact systems include a surface with one set of pads biased at a first voltage level, and another set of pads biased at a second voltage level. Such a contact system can be used, for example, to transfer power to an electromechanical device disposed thereon. In one particular example, the electromechanical device can include a power storage element and two or more couplings. When one of the couplings contacts a pad biased at the first voltage level, and another of the couplings contacts a pad biased at the second voltage level, a circuit is completed where some derivative of the differential between the first voltage level and the second voltage level is placed across the power storage element. Completion of the circuit causes the power storage element to charge. Power can be drawn from the power storage element to operate the electromechanical device.

67 Claims, 21 Drawing Sheets

SYSTEMS AND METHODS FOR PROVIDING ELECTRIC POWER TO MOBILE AND ARBITRARILY POSITIONED DEVICES

CROSS REFERENCE TO RELATED CASES

The present application claims the benefit of three U.S. Provisional Patent Applications: U.S. Provisional Patent Application No. 60/432,072 entitled "Method and Apparatus for Providing Electrical Power to Devices Arbitrarily Positioned or Moving on a 2-Dimensional Surface", filed on Dec. 10, 2002, by the inventor of the present application; U.S. Provisional Patent Application No. 60/441,794 entitled "Game System Involving a Game Controller and Electromechanical Game Devices", filed on Jan. 22, 2003, by the inventor of the present application; and U.S. Provisional Patent Application No. 60/444,826 entitled "Method and Apparatus to Communicate With and Individually Locate Multiple Remote Devices on a Two-Dimensional Surface", filed on Feb. 4, 2003, by the inventor of the present application. The entirety of each of the aforementioned provisional patent application Nos. 60/432,072, 60/441,794, and 60/444,826 is incorporated herein by reference for all purposes.

Further, the present application is related to U.S. patent application Ser. No. 10/613,915, now U.S. Pat. No. 6,866,557, entitled "Method and Apparatus for Producing Ambulatory Motion", filed on Jul. 2, 2003, by the inventor of the present invention. The entirety of the aforementioned U.S. patent application Ser. No. 10/613,915 (now U.S. Pat. No. 6,866,557) is incorporated herein by reference for all purposes.

FIELD OF THE INVENTION

The present invention relates generally to systems and methods for providing electric power and/or control systems to mobile and arbitrarily positioned electromechanical devices.

BACKGROUND OF THE INVENTION

A variety of electromechanical devices have been developed, along with methods for powering the devices. For example, radio controlled cars have been developed that operate under battery power. As a radio controlled car is operated the battery is exhausted, and, for operation to continue, the battery must be recharged. In a typical scenario, the battery is removed and recharged at a fixed location while the car remains inoperable.

Other toys, such as slot cars and electric trains, include a continuous power source derived from contact between the car or train and a track on which the toys operate. For the toys to operate properly, the train or slot car must remain properly aligned with the track. Where a misalignment occurs, the power is interrupted and operation stops. Movement of these cars and trains is typically limited to traversing a pre-defined path, thus limiting any entertainment possible through use of such devices.

Other approaches also exist for transferring power to electromechanical devices. For example, in a bumper car system power is supplied via a wand placed high overhead and in contact with a high power source. Power is transferred as it passes to the ground on which the bumper cars operate. Such an approach requires sandwiching the bumper cars between differential power planes. Such sandwiching can limit the accessibility and/or operability of any electromechanical device.

Hence, there exist needs in the art to address one or more of the aforementioned limitations, as well as other limitations.

SUMMARY OF THE INVENTION

The present invention provides various electric contact systems or surfaces for powering mobile and/or arbitrarily positioned electromechanical devices, as well as methods for manufacturing, using, and controlling such contact systems and electromechanical devices. Examples of the contact systems include a surface with one set of pads biased at a first voltage level, and another set of pads biased at a second voltage level. Such a contact system can be used, for example, to transfer power to an electromechanical device disposed thereon. In one particular example, the electromechanical device can include a power storage element and two or more couplings. When one of the couplings contacts a pad biased at the first voltage level, and another of the couplings contacts a pad biased at the second voltage level, a circuit is completed where some derivative of the differential between the first voltage level and the second voltage level is placed across the power storage element. Completion of the circuit causes the power storage element to charge, and in turn power can be drawn from the power storage element to operate the electromechanical device.

Such contact systems can be used for many purposes, such as robotic systems, display systems, testing systems, entertainment systems, and others. One example may be an overall game system that in some cases can combine the complexity, challenge, variety, and/or programmability of video arcade games with the appeal of real electromechanical game devices as the subjects of play. In one embodiment of such a system, a central-controller-based architecture allows independent electromechanical game devices to act intelligently and participate in a video-game-like play scenario. The central game controller communicates with and monitors the position of independent electromechanical game devices, and the central controller directs and manipulates the actions of independent electromechanical game devices via a closed-loop feedback control system. In some cases, the central controller further monitors critical status, sensory input, and identification of the independent electromechanical game devices. This central controller can operate using a hierarchical functional block so as to allow for an interface to the game controller such that the physical electromechanical game devices can be manipulated similarly to the way virtual characters are manipulated in well-established video game technology.

Contact systems in accordance with the present invention can be tailored, inter alia, to address one or more of the previously described limitations. For example, one or more of the contact systems disclosed herein can provide a means whereby power is transferred continuously, or almost continuously to an electromechanical device disposed on the contact system. Thus, the electromechanical device is not rendered inoperable while batteries are recharged. As another example, various of the contact systems can be implemented such that a continuous, or near continuous power transfer occurs from the contact system to an electromechanical device moving in arbitrary or controlled directions in divers locations across the surface of the contact system. Further, various of the contact systems can be designed such that power transfer occurs from a single surface, facilitating viewing from above of an electromechanical device as it traverses the contact system.

Particular embodiments of the present invention provide game surfaces including two or more sets of pads. Each of the sets of pads is electrically isolated from other sets of pads by an insulation region. This isolation allows for biasing one set of pads at a voltage level different from another set of pads. A power source coupling is included with one lead electrically coupled to one of the sets of pads, and another lead electrically coupled to another of the sets of pads. These leads can be connected to a power source such that the set of pads connected to one of the leads is biased at a first voltage level, and the set of pads connected to the other lead is biased at a second voltage level.

The pads can be distributed across the game surface at a frequency, size, and/or shape tailored to create a desired contact probability. This contact probability indicates the percentage of time that an electromechanical device randomly moving across the game surface will be receiving power from the game surface. In one particular embodiment, a repeating rectangular pad shape is utilized to achieve a contact probability of greater than eighty percent.

In some instances, the distance across the insulation region from one set of pads to another set of pads is greater than a dimension of a receiving contact or coupling associated with an electromechanical device disposed on the game surface. Such a receiving contact can be, for example, a foot of a legged electromechanical device, a brush of a wheeled electromechanical device, a brush of a flexible leg/brush device, or the like. Among other reasons, such a distance can limit the possibility of shorting between pads biased at differential voltage levels.

The game surface can include a transformer that supplies a power output to the game surface. This power output can be used to derive the differential voltage levels exhibited on the sets of pads. In one particular case, deriving the differential voltage levels includes applying one pole of the power output to one set of pads, and applying another pole of the power output to another set of pads. In various cases, the differential power output is current and/or voltage limited before being applied to the sets of pads. In some cases, the power output is a direct current output where one pole of the power output is, for example, a positive five volt supply, and the other pole of the power output is a ground. In yet other cases, the power output is an eight volt alternating current. Thus, voltage levels applied to the sets of pads alternate. This can be an advantage where an alternating current output results in reduced arcing between the pads and the receiving contacts associated with electromechanical devices used on the game surface.

A number of surface configurations are possible in accordance with the present invention. For example, an upper portion of the game surface comprising the plurality of first pads, the plurality of second pads, and the insulation region can be formed as a continuous, two-dimensional surface; a continuous, three-dimensional surface; or a non-continuous three-dimensional surface. Examples of each of these surface configurations are provided in the detailed description of this document.

Other embodiments of the present invention provide game systems using various of the game surfaces described above. The game systems include a power source that provides power to bias the sets of pads at differential voltage levels. The systems further include one or more electromechanical devices. Each of the electromechanical devices includes a movement element, a power storage element, and a plurality of couplings. The plurality of couplings contact the game surface and complete a circuit that includes the power storage element, a first conductive contact between a pad from one set of pads, and a second conductive contact between another of the couplings and a pad from the other set of pads. Completion of the circuit causes the power storage element to charge.

The power storage element can include, but is not limited to, one or more capacitors and/or one or more rechargeable batteries. Further, the movement element can be, but is not limited to, a leg, a flexible brush, a wheel, or the like. The couplings or electrical contacts associated with the electromechanical devices can be, for example, brushes or other types of electrical contacts.

Yet other embodiments of the present invention provide methods for manufacturing contact systems. The methods include providing a substantially non-conductive substrate. Conductive material is formed on the substantially non-conductive substrate, and sets of pads are defined in the conductive material, with an insulation layer defined between the sets of pads. In some cases, the conductive material is formed on the substantially non-conductive substrate before the pads and insulation region are defined, while in other cases, the definition of pads and insulation region occurs before or simultaneous to forming the conductive material on the substantially non-conductive substrate.

This summary provides only a general outline of some embodiments of the present invention. Many other objects, features, advantages and other embodiments of the present invention will become more fully apparent from the following detailed description, the appended claims and the accompanying drawings.

BRIEF DESCRIPTION OF THE DRAWINGS

A further understanding of the various embodiments of the present invention may be realized by reference to the figures which are described in remaining portions of the specification. In the figures, like reference numerals are used throughout several to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION

Figure 2A:
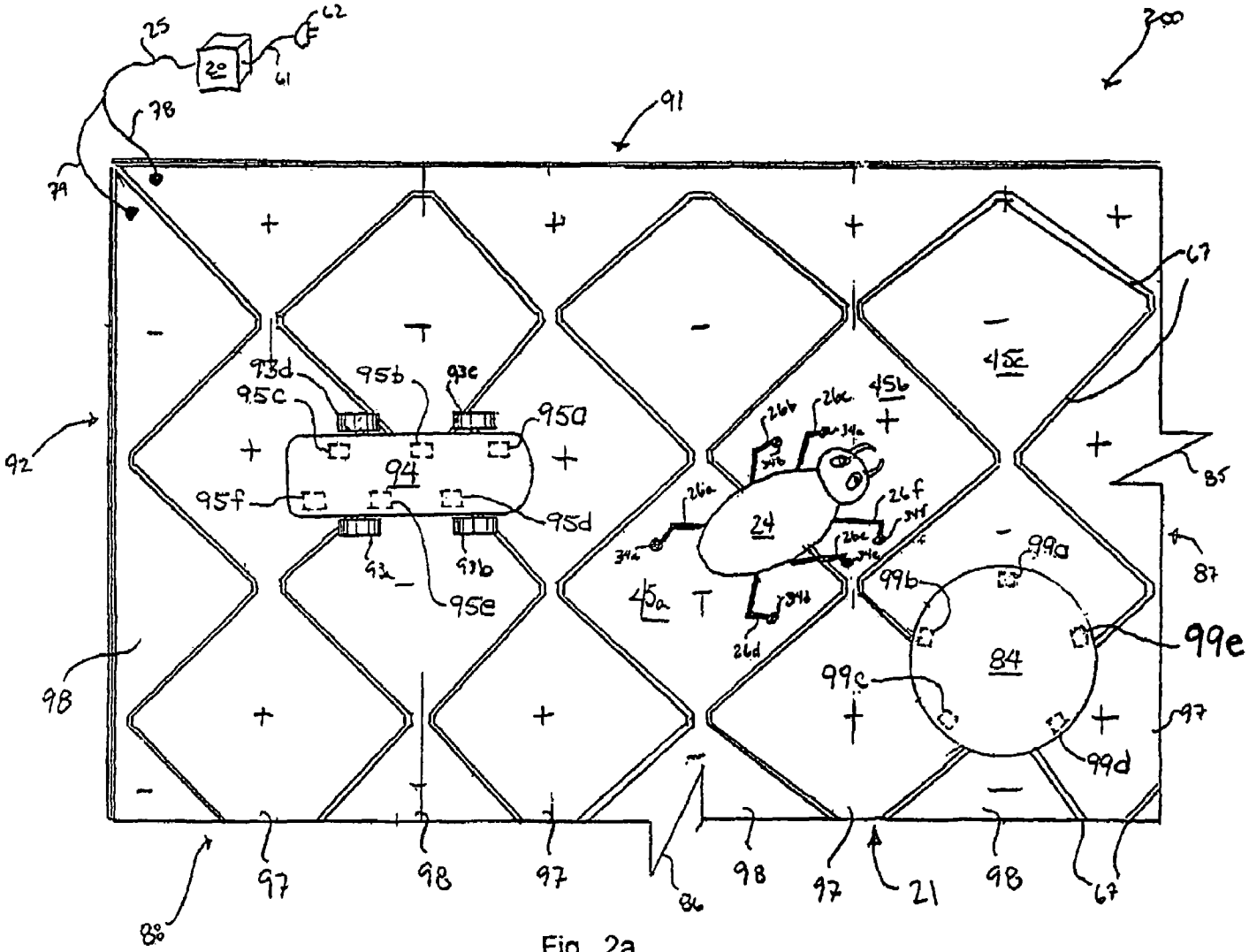
FIG. 2 are close-up top views of power array patterns in accordance with some embodiments of the present invention.

Three examples of mobile, electrically powered electromechanical devices 24, 84, 94 are shown in FIG. 2*a* positioned on an electric contact system portion 200, which provides electric power to the electromechanical devices 24, 84, 94 according to this invention. For an overview of the principles of this invention, reference is made first to the electromechanical device 24, which is in the form of an ambulatory mechanical bug such as, but not limited to, those described in co-pending U.S. patent application Ser. No. 10/613,915, which is supported by its legs 26 on the surfaces of several of the pad segments 45 of the contact system portion 200. The pad segments 45 are connected via leads 78, 79 to an electric power source 20, and the electromechanical device 24 draws its electric power to operate, e.g., to move around on the contact system portion 200, through its legs 26 from the pad segments 45. As illustrated by the negative (−) and positive (+) symbols on the pad segments 45 adjacent the electromechanical device 24 pad segments 45*a* are at one voltage level indicated by the "−" and pad segments 45*b* are at another voltage level indicated by the "+". Any time that at least one of the legs 26 is in contact with a pad segment 45*a* of one voltage level "−" and at least one other of the legs 26 is in contact with another pad segment 45*b* of another voltage level "+", electric current can flow to the electromechanical device 24 to charge a storage device 44 (FIG. 3*a*) and/or power a motor 48 (FIG. 3*a*) in the electromechanical device 24. Therefore, the electromechanical device 24 can move around to divers locations on the contact system portion 200 and still obtain electric power for its operation from the various pads 45 at such divers locations.

Figure 3A:
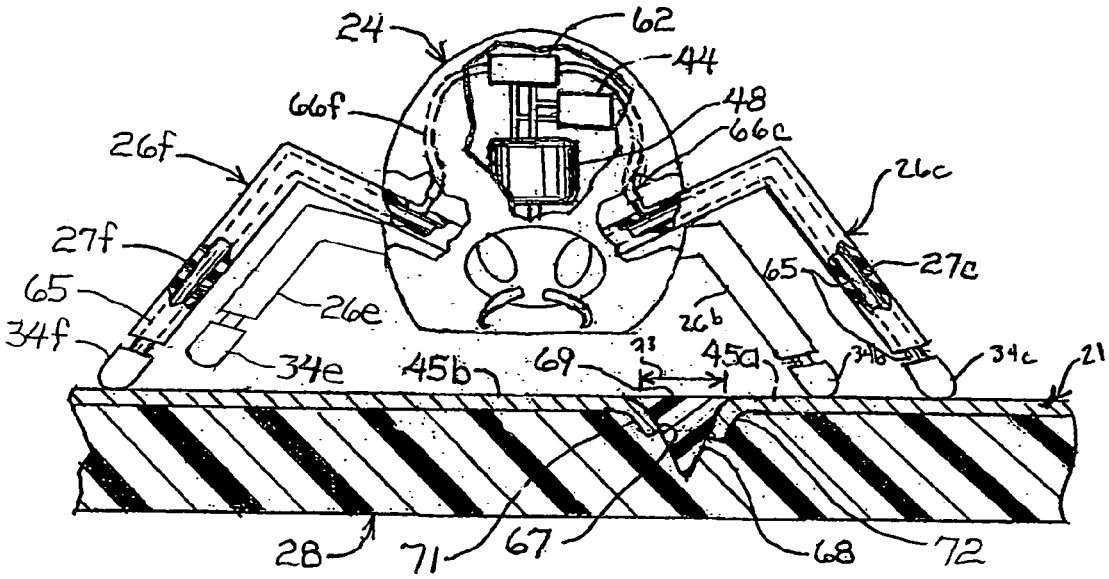
FIG. 3 are close-up side views of the contact system of FIG. 1 including a legged and brushed electromechanical devices placed thereon.

As best seen in FIG. 3*a*, each leg 26 has an electric contact or "foot" 34 that makes electric contact with the surfaces of pad segments 45. Therefore, as the legs 26 support the electromechanical device 24 on the surfaces of the pad segments 45, the feet 34 provide electrical connections of the electromechanical device 24 with the power array 21 of the contact system portion 200. An electrically conductive component 65 extends from the foot 34 through the leg 26, which can be covered with insulation 27 to prevent short circuits with legs of other electromechanical devices not shown in FIG. 3*a*, to extend the electric circuit into the body portion 26 of the electromechanical device 10, where the rectifier circuit 62, storage device 44, and motor 48 are located. The conductive component 65 can be a structural member of the leg 26 or just a wire or other lead, depending on design and structural criteria, as will be understood by persons skilled in the art. Any suitable electric wire or lead 66 can connect the conductive component 65 in the leg 26 to the rectifier circuit 62, which is shown in more detail in FIG. 5. Essentially, the rectifier circuit 62, which will be described in more detail below, delivers electric power with the correct polarity to the storage device 44 and/or motor 48 (FIG. 3*a*), regardless of whether a particular foot 34 happens to be in contact with a pad segment 45*a* biased at the "−" voltage level or with a pad segment 45*b* biased at the "+" voltage level at any particular instant in time. Therefore, whenever at least one foot 34, for example foot 34*c* in FIG. 3*a*, contacts a pad segment 45*a* at the "−" voltage level and at least one other foot 34, for example foot 34*f* in FIG. 3*a*, contacts a pad 45*b* biased at the "+" voltage level, electric current can flow through the conductive components 65 of legs 26, the leads 66, and the rectifier circuit 62 to the storage device 44 and/or motor 48 to power and operate the electromechanical device 24.

The contact system of FIG. 2*a* and other variations will be described in more detail below, but, as shown in FIGS. 2*a* and 3*a*, it can comprise a substrate 28, which supports the pad segments 45 of the power array 21. The pads 45*a*, 45*b* are biased at different voltage levels and separated by a gap 67, which can be filled with an electrically insulating material 68 to provide a continuous, smooth, non-conductive surface 69 between the pad segments 45*a*, 45*b*. Of course, many other contact system structures can also be used to implement this invention, and they can have many purposes, such as game boards, toys, riding vehicles for children, tactical weapons displays, monitoring displays for mobile devices, robotic machine systems, and many others. Many different control systems and other variations, some examples of which will be discussed below, can also be used with this invention to control movements of the electromechanical device 24 to divers locations on the contact system.

The present invention also provides various contact systems, game controllers, game devices, as well as methods for manufacturing and using such. Examples of the contact systems include a surface with one set of pads biased at a first voltage level, and another set of pads biased at a second voltage level.

Figure 4:
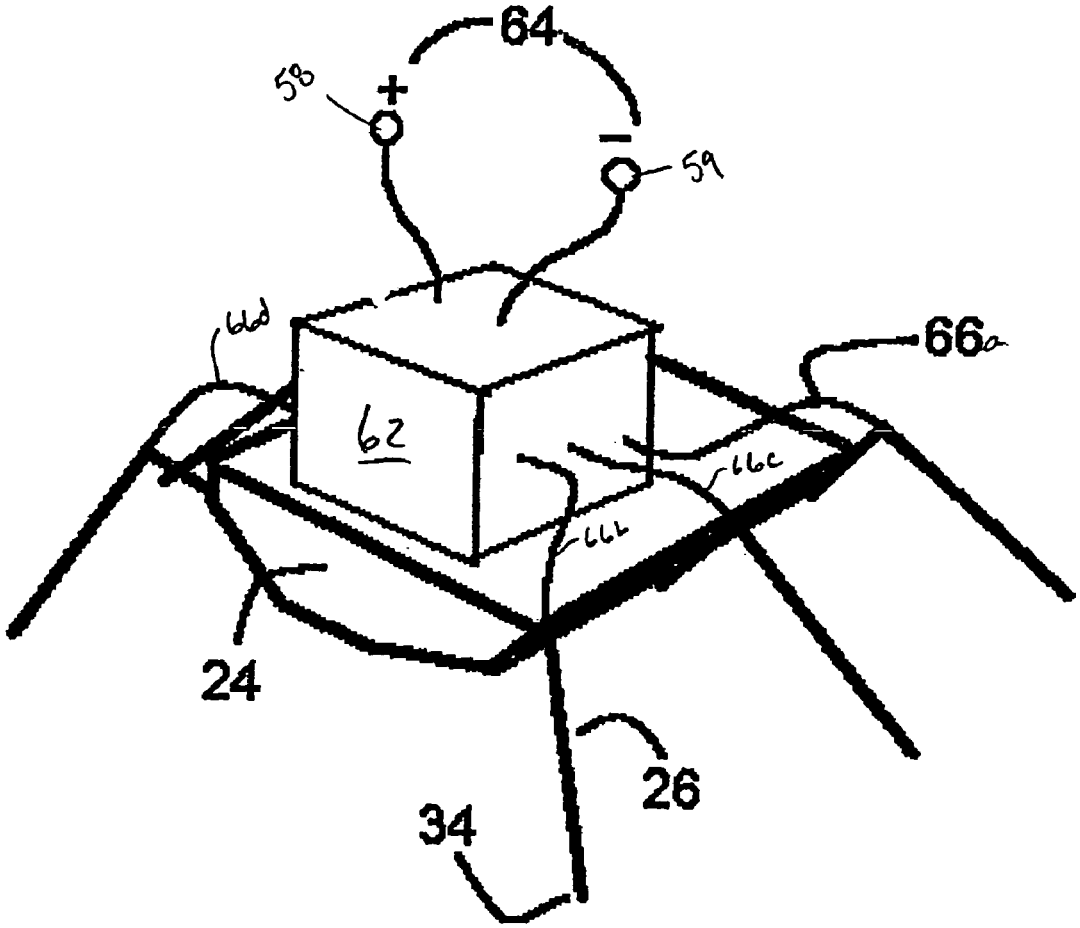
FIG. 4 illustrates the physical layout of an exemplary electromechanical device including a power storage element in accordance with some embodiments of the present invention.
Figure 7:
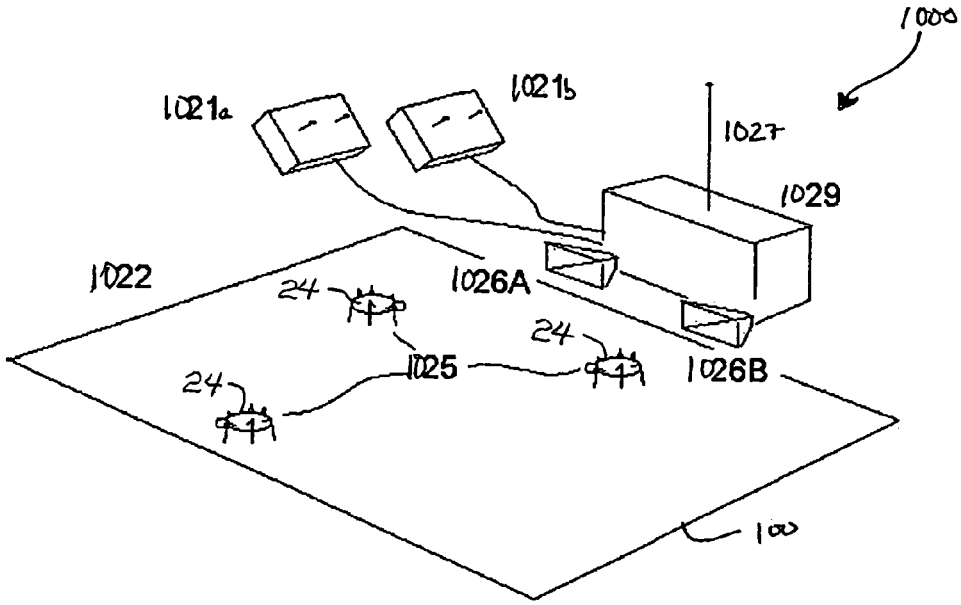
FIGS. 7–10 depict a game system and attributes thereof in accordance with various embodiments of the present invention.

Such contact systems can be used in relation to, for example, a game system that includes one or more electromechanical devices operating on a contact system. One such game system is depicted in FIG. 7 and will be more fully described below. In the game system of FIG. 7, one or more electromechanical devices, for example, electromechanical devices 24, are placed on a contact system that is capable of transferring power to the electromechanical devices as described above. In one particular example, the electromechanical devices can include a power storage element and two or more couplings as depicted in FIGS. 3*a* and 4 and more fully described below. In the case of FIGS. 3*a* and 4, the couplings include feet 34 attached to legs 26 of a bug-like electromechanical device 24. These couplings electrically conduct power from the underlying contact system to the electromechanical device 24. The top surface pattern of an example contact system 200 including a bug-like electromechanical device 24, as well as a puck 84 and a car-shaped device 94, disposed thereon is illustrated in FIG. 2*a*. The surface of the contact system 200 includes groups of pads biased at different voltage levels indicated by "+" and "−" signs on the pads. Some feet 34 of the bug-like electromechanical device 24 are in contact with "+" pads 45*b*, and others with "−" pads 45*a*. These feet 34 in contact with the pads 45*a*, 45*b* form a circuit where the voltage differential between the "+" pads and the "−" pads is placed across a power storage element 44 (FIG. 3*a*) associated with the bug-like electromechanical device 34. This causes the power storage element 44 to charge, and power from the power storage element 44 can be used to operate the bug-like electromechanical device 24. It should be understood that the foregoing discussion is only an overview, and that the present invention encompasses myriad different approaches, hardware, and applications, some examples of which are more fully set forth below.

Further, it should be appreciated that in the previously discussed game system, the electromechanical devices can be powered while they move to divers positions on the contact system. Thus, the game system can be implemented to combine the complexity, challenge, variety, and/or programmability of video arcade games with the appeal of real electromechanical game devices as the subjects of play. In one embodiment, a central-controller-based architecture allows independent electromechanical game devices to act intelligently and participate in a video-game-like play scenario. The central game controller communicates with and monitors the positions of independent electromechanical game devices, and the central controller directs and manipulates the actions of independent electromechanical game devices via closed-loop feedback control systems. In some cases, the central controller further monitors critical status, sensory input, and identification of the independent electromechanical game devices. This central controller can operate using a hierarchical functional block so as to allow for an interface to the game controller such that the physical electromechanical game devices can be manipulated similarly to the way virtual characters are manipulated in well-established video game technology.

A variety of electromechanical devices can be used in relation to the previously described game system. These electromechanical devices can include, but are not limited to, wheeled electromechanical devices 94 and legged electromechanical devices 24 that can move under their own power, as well as more passive devices, such as a puck 84 that must be moved by other electromechanical devices on the contact system. Such passive devices, e.g., puck 84, can be powered by the contact system 200 with the power being used to operate location circuitry within the passive device, which can communicate with a central controller or with other devices on the contact system.

Figure 1A:
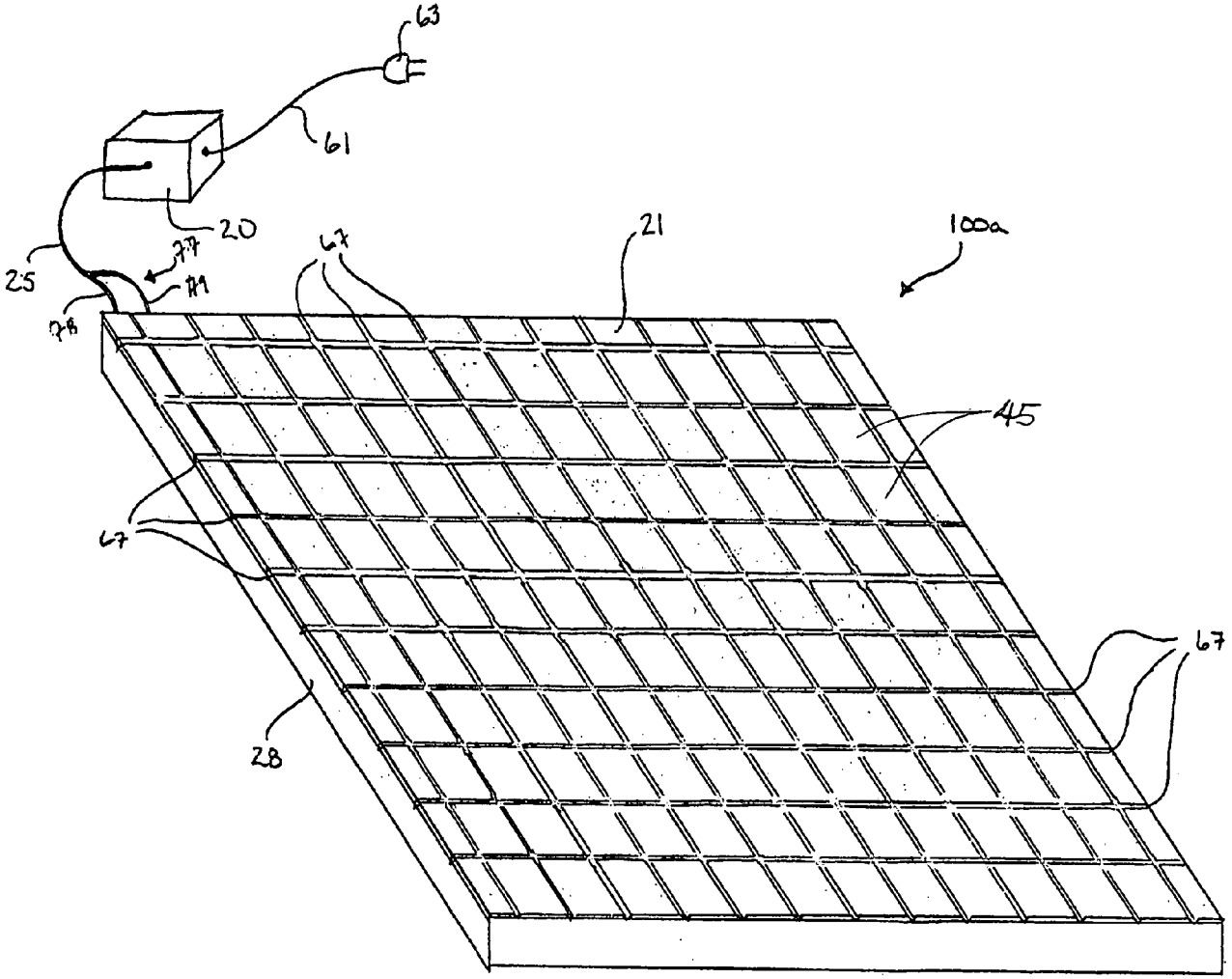
FIG. 1 depict some contact systems in accordance with various embodiments of the present invention.

Referring to FIG. 1, various contact systems 100*a*, 100*b*, 100*c* in accordance with some embodiments of the present invention are illustrated. Turning to FIG. 1*a*, contact system 100*a* includes a power array 21 comprised of a number of pads 45 formed of substantially conductive material or coated with substantially conductive material (examples of such pads are respectively labeled 45*a*, 45*b* and 45*c*). As used herein, a substantially conductive material can include any material capable of acting as an electrical conductor of enough power to operate an electromechanical device on the contact system 100. Thus, substantially conductive materials may include, but are not limited to, metals, metal oxides, doped semiconductor materials, and the like. In some embodiments, pads 45 are plated with tin or nickel and passivated to provide a durable, conductive, corrosion resistant surface. Passivated nickel is relatively hard and is sufficiently conductive to offer good performance. As another alternative, tin offers very good performance. Other materials may be chosen as performance and cost factors dictate.

Pads 45 are disposed on a substantially non-conductive substrate 28. As used herein, a substantially non-conductive material can include any material capable of acting as a dielectric. Thus, substantially non-conductive materials include, but are not limited to, plastic, glass, rubber, non-conductive paint, ambient air, paper or paper fibers, ceramic, undoped semiconductor materials, and the like. In some cases, substrate 28 can be substantially thicker than power array 21, and can provide support for contact system 100*a* and/or define the surface topology of contact system 100*a*.

Power array 21 can be laminated or bonded to substrate 28. Alternatively, power array 21 can be formed atop substrate 28 by etching, deposition, printing with a conductive ink, and/or any other method of electrode formation known in the art. The method for associating power array 21 with substrate 28 can include considerations of mechanical stability and ease of fabrication.

The surface area of each of the pads 45 is defined by a bordering gap or insulation region 67 around the perimeters of the pads 45. As used herein, an insulation region can be any region of substantially non-conductive material being either contiguous or not. Thus, insulation region 67 can include a number of sub-regions that can be connected one to another, isolated one from another, and/or a combination thereof. As just one example, insulation region 67 can include a number of spaced apart openings forming lines across the surface of contact system 100*a*, and interspersed between pads 45. Such spaced apart openings can be filled with a substantially non-conducive material 68 (FIG. 3*a*), or they can be left open with the ambient air acting as a dielectric material filling the spaced apart openings. As further discussed below, two example patterns of pads 45 and insulation region 67 are depicted in FIG. 2, but many other patterns can be devised within the scope of this invention by persons of ordinary skill in the art, once they understand the principles of this invention.

Contact system 100*a* is formed such that an upper surface of pads 45 and insulation region 67 define a continuous, two-dimensional upper surface. As used herein, a continuous, two-dimensional surface can be any continuous surface area that stretches out in two dimensions.

In one particular embodiment, power array 21 is fabricated using die cutting techniques. This method can include, for example, making die cuts that extend through power array 21, but not through substrate 28. In some cases, the die cuts are made to power array 21 prior to adhering power array 21 to substrate 28. In other cases, the die cuts are performed after power array 21 is adhered to substrate 28.

When die cuts are performed after adhering power array 21 to substrate 28, the conductive material of power array 21 is bent at the location of the die cuts, as illustrated, for example, by bent edges 71, 72 in FIG. 3*a*, leaving a crevice 67 that makes an electrical open circuit between adjacent pads 45 of power array 21. In some cases, the gap 67 between adjacent pads 45 may not be large enough to prevent a short circuit by an electromechanical device operating on power array 21, if the foot 34, brush, or other contact has a contact surface that is wide enough to span the gap 67. To alleviate this potential for short circuiting, a nonconductive paint can be silk-screened over the cuts. The paint could appear as strips with a width sufficient to prevent shorting, or they can be just high enough over the surfaces of the pads 45*a*, 45*b* to hold a contact surface on the electromechanical device, which is positioned on a strip, from touching the adjacent pads 45. The paint can also serve to fill the crevices so the surface is smooth. In addition, the paint can help to insure that the metal does not flex and creep causing a short circuit. Additionally, multiple paint colors can be used to mark patterns on the surface of power array 21.

It should be noted that contact system 100*a* can include a single continuous, two-dimensional area where pads 45 are evenly distributed as illustrated in FIG. 1*a*. Alternatively, contact system 100*a* can include some areas that either do not include pads 45, or where pads 45 are not connected to the power source 20 or are otherwise not operational to transfer power. Such an embodiment may be desirable where electromechanical devices placed on contact system 100*a* are to be deprived of electrical power when such devices operate in areas where there are either no pads 45, or where the pads 45 are not operational. Switching circuitry or other control systems, (not shown) can be used to switch selected ones of the pads 45 on and off to vary the operability of the pads, as will be understood by persons skilled in the art. Use of such nonoperational pads 45 can be for any desired purpose, for example, to vary advantages to various electromechanical devices operating as game pieces on the contact system serving as a game board.

Contact system 100*a* is coupled to a power source 20 via a power source coupling 25 including leads 77. Leads 77 can be electrically coupled to power array 21 by any process and/or mechanism known in the art including, but not limited to, solder or rivets. In the illustrated embodiment, leads 77 include a first voltage level lead 78 and a second voltage level lead 79. Another power source coupling 61 attaches power source 20 to a power plug 63. Plug 63 is tailored for accepting an alternating current (hereinafter "AC") source at a voltage level available from an electrical outlet. In one embodiment, the AC power from the electrical outlet is converted by power source 20 to another AC power source at a different voltage level. In another embodiment, the AC power from the electrical outlet is converted by power source 20 to a direct current (hereinafter "DC") power source at a different voltage level, and in yet other embodiments, plug 63 is tailored to receive DC power which is converted to DC power at a different voltage level. It should also be recognized that in some cases, power transformation may not be required, and in such cases, power source 20 may not include transformation capability. As just one example where power is not transformed, power source 20 can be a battery pack.

Any sufficiently large conductive object (such as a coin) sitting on power array 21 could inadvertently cause a short circuit. Therefore, in some cases, power source 20 can include current limit circuitry, and also may be thermally protected. A resetable fuse and series current limiting resistor could be used as an inexpensive means of protection, but protection is not limited to this technique.

Based on the disclosure provided herein, it should be recognized that power source 20 can be any unit capable of supplying and/or converting power for use by contact system 100*a*. In one embodiment, the power supplied by power source 20 is DC electrical power. In another embodiment, the electrical power supplied by power source 20 is AC electrical power, including single-phase, two-phase, and three-phase AC power. Power source 20 can comprise a battery, an AC transformer connected to a common household AC source, an AC-DC rectifier/converter connected to a common household AC source, and/or the like.

The power output from power source 20 is fed to contact system 100*a*. Thus, for example, plug 63 may accept one hundred twenty volts (120 V) AC, and power source 20 converts that 120 V AC to eight volts (8 V) AC that is applied to contact system 100*a*. In one particular embodiment, one group of pads 45 is biased at a first voltage level through electrical coupling with one of leads 78, 79, and another group of pads 45 is biased at another voltage level through electrical coupling with the other of leads 78, 79. Based on the disclosure provided herein, one of ordinary skill in the art will appreciate that three or more groups of pads can each be biased at different voltage levels and/or phases.

If power source 20 provides an AC power output to contact system 100*a*, some efficiency may be lost due to the greater resistive ($I^2R$) losses of power array 21 for a given average current when compared to a DC supply at the same voltage level. However, an AC supply, in combination with resistive current limiting and a resetable fuse can provide an inexpensive means of providing power to power array 21. In addition, AC excitation tends to extinguish arcs and would extend the life of the intermittently contacting feet and/or brushes of electromechanical devices operating on contact system 100*a*. The use of an AC source may also reduce radiated electromagnetic noise that may interfere with a control system associated with contact system 100.

In one particular embodiment of the present invention, power array 21 is formed of a number of copper or tin plated copper pads 45 disposed on top of a paper fiber board substrate 28. Groups of pads 45 biased at one voltage level are separated from groups of pads biased at another voltage level by the gap or insulation region 67 formed of spaced apart openings filled with ambient air or insulation material. Contact system 100*a* can be substantially rigid, or alternatively, substantially flexible such that it can be rolled, folded, and/or otherwise manipulated for ease in handling, transportation, and storage.

Figure 1B:
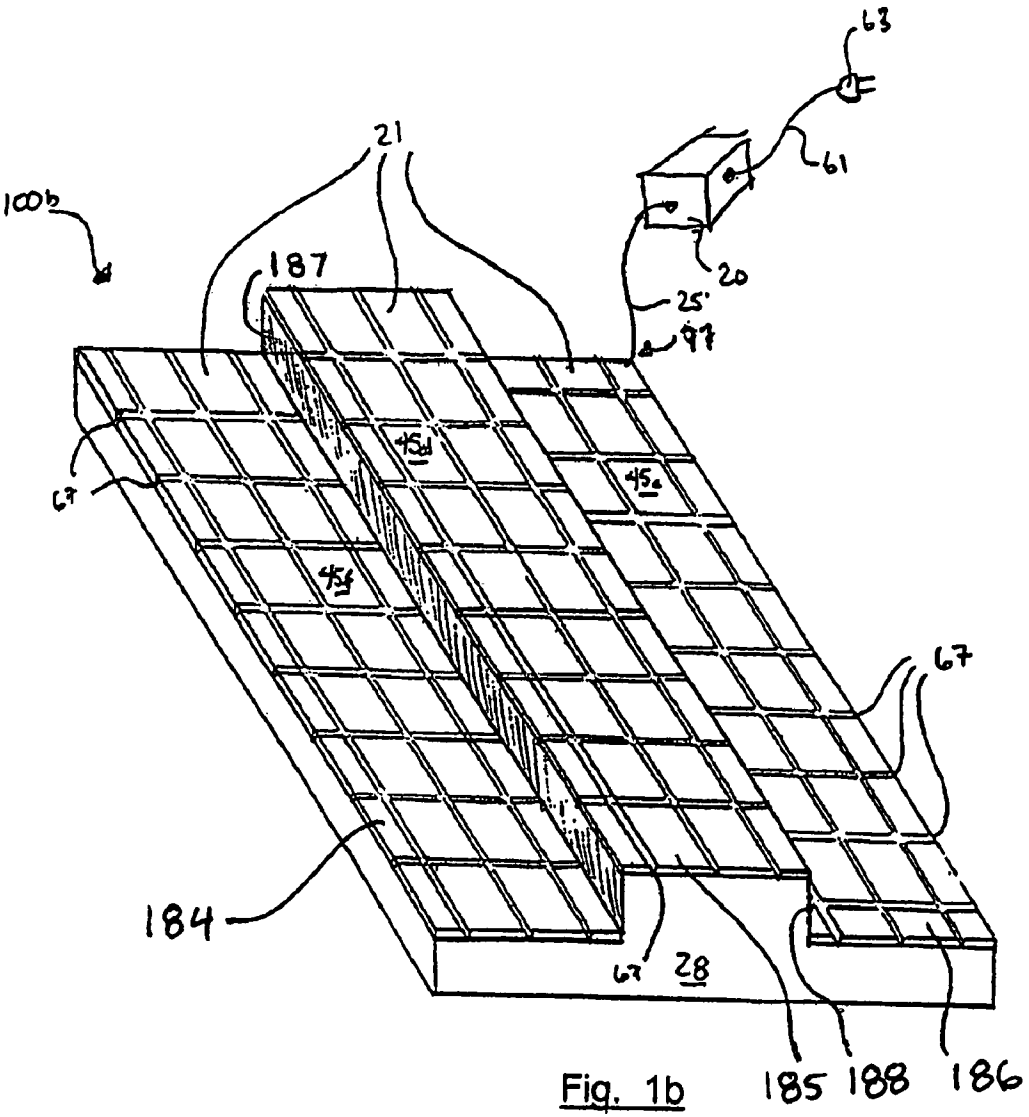

Turning to FIG. 1*b*, contact system 100*b* in accordance with some embodiments of the present invention is illustrated. Contact system 100*b* is substantially the same as the previously described contact system 100*a*, except that contact system 100*b* is formed such that an upper surface of pads 45 (examples of such pads being labeled 45*d*, 45*e*, 45*f*) and insulation region 67 define a non-continuous, three-dimensional upper surface including surfaces 184, 185, 186. As used herein, a non-continuous, three-dimensional surface can be any surface area that includes two or more surface areas separated by a step or other non-continuous feature. From this description, it should be recognized that a non-continuous, three-dimensional surface can include any combination of continuous, two-dimensional and/or continuous, three-dimensional surfaces (further defined below).

As illustrated in FIG. 1*b*, pads 45 and the portion of insulation region 67 forming surface 184 are separated from those of surface 185 by a step 187. Similarly, surface 185 is not continuous with surface 186 as they are separated by a step 188. Such a contact system may be desirable where, as just one example, an electromechanical device disposed on contact system 100*b* is intended to traverse one or more steps, a staggered topology, and/or other obstacles.

Figure 1C:
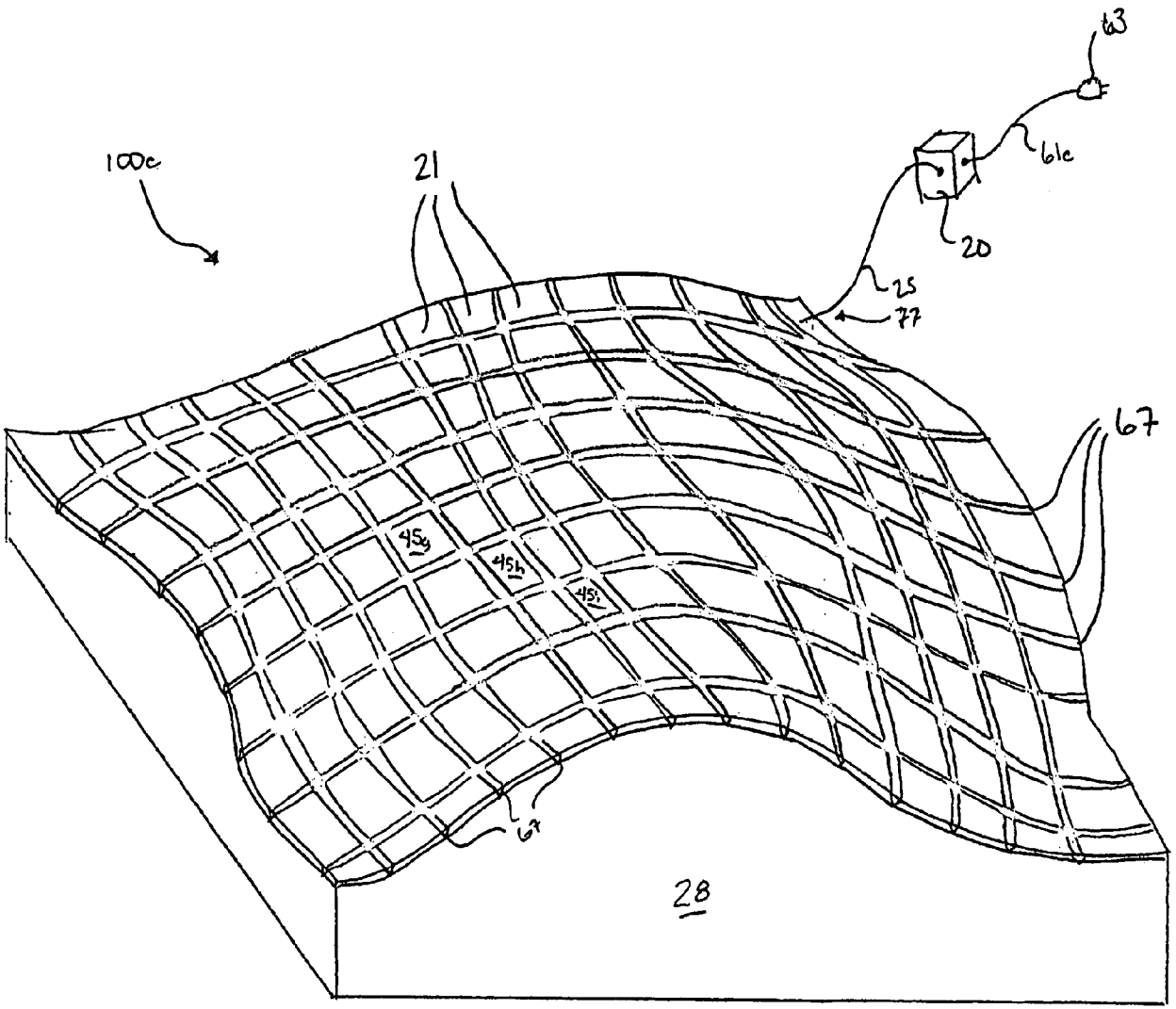

Contact system 100*c* of FIG. 1*c* is also substantially similar to the previously described contact system 100*a*, except that contact system 100*c* is formed such that an upper surface of pads 45 (examples of such pads being labeled 45*g*, 45*h*, 45*i*) and insulation region 67 define a continuous, three-dimensional upper surface. As used herein, a continuous, three-dimensional surface can be any continuous surface area that stretches out in more than two dimensions. From this description, it should be recognized that a continuous, three-dimensional surface can include portions that could be described as continuous, two-dimensional areas.

It should be noted that contact system 100*c* can include a single continuous area where pads 45 are evenly distributed as illustrated. Alternatively, contact system 100*c* can include areas that either do not include pads 45, or where pads 45 are not operational to transfer power. Such an embodiment can be desirable where electromechanical devices placed on contact system 100*c* are to be deprived of electrical power when such devices operate in areas where there are either no pads 45, or where the pads 45 are not operational.

Contact systems 100 can be formed to include a combination of continuous, two-dimensional surface areas; continuous, three-dimensional surface areas; and/or non-continuous, three-dimensional surface areas. Further, contact systems 100 can be formed of a number of contact system portions or blocks (not shown) assembled to make a single contact system. This can be desirable where a variety of topologies are to be used over time in relation to, for example, a game involving electromechanical devices traversing the surface of the contact system. In some cases, such a building block approach can include placing two or more power arrays 21 and/or substrates 28 adjacent to one-another to increase the usable area. Each power array 21 could either be electrically connected to the same power source 20, or could use its own separate power source 20.

Contact systems 100 can be tailored to provide one or more desirable attributes. For example, contact systems 100 can be tailored to provide a means whereby power is transferred continuously, or almost continuously to an electromechanical device operating on the contact system. In some cases, such power transfer can occur on a continuous or near continuous basis as the electromechanical device moves in various directions across the surface of contact system 100, thus allowing electromechanical devices operating on contact system 100 to behave as though they carried their own endless (or what appears to be endless) source of power. In particular cases, contact systems 100 can be deployed such that power transfer occurs from a single surface, thus facilitating overhead viewing of an electromechanical device as it traverses the contact system. Based on the disclosure provided herein, one of ordinary skill in the art will appreciate myriad other advantages that can be achieved using one or more of the contact systems depicted in FIG. 1.

FIG. 2 are close-up top views 200, 201 illustrating the pattern of power array 21 and another power array 22 in accordance with different embodiments of the present invention. Turning to FIG. 2*a*, view 200 shows a plurality of substantially rectangular pads 45 (examples of such pads are labeled as 45*a*, 45*b*, 45*c*) repeating to form power array 21. Pads 45 are defined by interspersed insulation region 67. As indicated by the "+" and "−" symbols, one group 97 of pads 45 are biased at one voltage level (indicated by "+"), and another group 98 of pads 45 are biased at another voltage level (indicated by "−").

Pads 45 are biased at the two voltage levels by continuous electrical contact with one of leads 78, 79, respectively. As can be seen, sides 87 and 88 of power array 21 continue as noted by the continuation symbols 85, 86. In contrast, sides 91 and 92 show the termination of power array 21. As shown along side 91, all of the "+" pads 97 are electrically coupled to lead 78 by relatively thin conductive regions of power array 21 extending along side 91. As depicted on side 92, the "−" voltage biasing from lead 79 is electrically coupled through the pads extending down side 92. What is not shown, is that these pads 45 along side 92 are also electrically coupled along side 88 where that side terminates. The coupling at the termination of side 88 is similar to that previously discussed in relation to side 91. Thus, all negative pads can be electrically coupled to one another, and to lead 79.

Pads 45 in the illustrated embodiment are symmetrically and regularly spaced in order to provide a maximum coverage of power array 21, and to provide a minimum of separation space between pads 45. This minimum separation is further discussed in relation to FIG. 3 below. By minimizing the distance between pads 45, the surface coverage by pads and likelihood of making electrical contact is increased.

Based on the disclosure provided herein, it should be recognized that pads 45 can be formed of any shape depending upon the desired result. Such desired results can include, but are not limited to, maximizing the possibility of contact between legs 26 and pads 45 biased at different voltage levels, distribution of power in accordance with a game that is to be played on the surface, and/or the like. The pattern can be formed of irregular shapes, regular shapes, and/or any combination thereof. Regular shapes can include, but are not limited to triangles, rectangles, squares, or other polygons; circles; ovals; and/or the like.

View 200 also shows a wheeled electromechanical device 94, a legged electromechanical device 24, and a passive puck device 84 placed on the surface defined by power array 21 and insulation region 67. Passive puck device includes a number of brushes 99 that provide for receiving power from the underlying contact system. The brushe 99 are shown in phantom lines, because they are positioned under the puck 94, of course, to make electrical connection with the contact pads 45. Also, while the brushes 99 are shown larger due to drawing scale constraints in FIG. 2*a*, they are actually narrower than the gaps 67 or insulation material covering gaps 67 to prevent short circuits between pads 45 of different voltage levels, as explained above. This is also the case for the brushes 95 of the wheeled device 94. Legged electromechanical device 24 includes a number of electrically conductive legs 26 (or feet attached thereto) that provide for both movement and charging of legged electromechanical device 24. Legged electromechanical device 24 is further described below in relation to FIG. 3*a*, and additionally in U.S. patent application Ser. No. 10/613,915 (now issued U.S. Pat. No. 6,866,557), the entirety of which is incorporated herein by reference for all purposes.

In some cases, legs 26 of legged electromechanical device 24 are electrically insulated from each other by any known technique, such as non-conductive bushings, connecting pins, and the like (not shown) in mechanical connections of legs 26 to other drive components, which allows for contact between any of the legs 26 of multiple legged electromechanical devices 24 with any of the pads 45, regardless of voltage polarity or relative voltage levels of the respective pads 45 that are in contact with the legs 26, without short circuiting the power array 21. Also, it may be desirable to cover the legs 26 with insulation 27, except the point or surface area that contacts the pads 45, so that contact between legs 26 of the same electromechanical device 24 or between legs 26 of two or more different legged electromechanical devices 24 operating on the same contact system 100 would not short circuit the power array 21.

As illustrated, one or more of legs 26 contact one voltage level (indicated by "+"), and other of legs 26 contact another voltage level (indicated by "−"). Please note, however, that the "+" and "−" notation is used for convenience and could, but does not have to, mean strictly positive and negative polarity. This notation is intended to be relative and could, for example, include "8 volts" and "0 volts" levels "8 volts" or "9 volts" and "3 volts" levels. In other words, the "+" and "−" notation includes any differential voltage levels from which electric power can be derived to operate or charge the electromechanical device 24. The voltage differential across various of legs 26 in the example electromechanical device 24 in FIG. 3*a* is used to charge a power storage device 44 associated with the legged electromechanical device 24 and/or to operate a motor 48 associated with the legged electromechanical device 24. This operation is further described in relation to FIGS. 4 and 5 below.

In an example placement, legged electromechanical device 24 may or may not be able to extract power from pads 45 depending on where legs 26 are distributed on the surface of power array 21. If any two of the legs 26 are touching opposite "+" and "−" pads 45, then electric power can be routed through those two legs 26 to charge the storage device and/or operate the electromechanical device 24. If all of the legs 26 are touching pads 45 biased at the same voltage level, then no electrical power is transferred to legged electromechanical device 24 until one or more legs 26 are moved to a pad 45 biased at a different voltage level. However, the power storage device has enough capacity to operate the electromechanical device 10 such short periods of no electric power transfer until at least two of the legs 26 move again into position where they are touching opposite "+" and "−" pads 45.

In the example electromechanical device 24, some of the legs 26 are in a step mode, such as leg 26*e* in FIG. 3*a* with the foot 34*e* lifted above the surfaces of the pads 45, while other legs 26 are in a stride mode, such as legs 26*b*, 26*c*, and 26*f* in FIG. 3*a* with their respective feet 34*b*, 34*c*, and 34*f* in contact with the surfaces of pads 45 to support and propel the device 24 on the pads 45. Of course, there has to be enough of the feet 34 on the pads 45 at any instant in time to provide stability for the device 24, so the electric current to power the device 24 can flow from the pads 45 through any of the feet 34 that happen to be in contact with the pads 45 at any instant in time. Then, by the time any of those feet, for example, foot 34*f*, rises above the surface of the pad 45 for its step mode, at least one other foot, for example, foot 34*e*, will have finished its step mode and returned into contact with the pad 45. Thus, electric current flow is intermittent in any particular leg 26 as it cycles between stride and step modes, but there will be an electric current flow whenever at least one foot 34 is touching a pad 45 at one voltage level "−" and at least one other foot 34 is touching another pad 45 at another voltage level "+" at the same time. Also, if the device 24 turns or moves in some manner to a different position in which a foot 34 moves from a pad 45 of one voltage level "−" to a pd 34 of a different voltage level "+", there will still be another foot 34 remaining on the pad 45 at the one voltage level "−" and/or such movement of device 24 will move a different leg 26 from the pad 45 at the other voltage level "+" to a pad 45 of the one voltage level "−", so that there will still be a current flow. The rectifier circuit 62 routes those current flows from all of the legs 26 in an appropriate manner to charge the storage device 44 and/or separate the motor 48, regardless of which feet 34 happen to be in electrical contact with which of the pads 45 at different voltage levels "−" or "+".

Figure 3B:
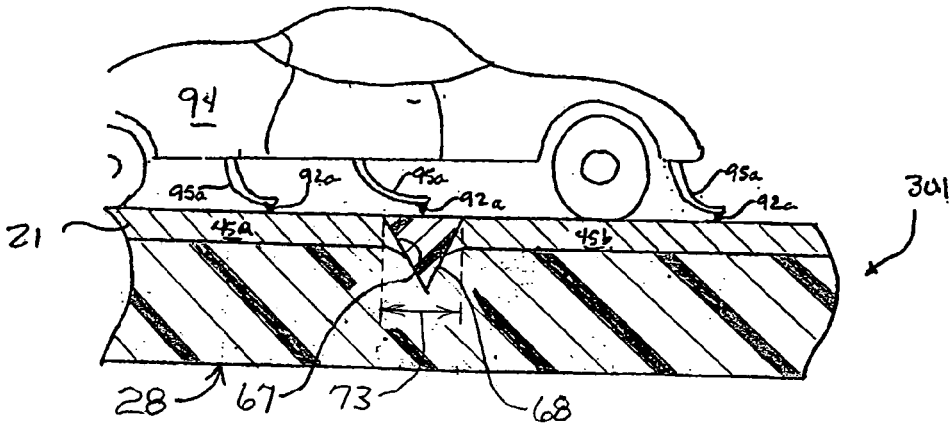

Wheeled electromechanical device 94 includes four wheels 93 mechanically coupled to a motor system (not shown, but similar to motor 44 of device 24) capable of steering and moving wheeled electromechanical device 94. In addition, wheeled electromechanical device 94 includes two or more flexible brushes 95. Flexible brushes 95 extend from the bottom of wheeled electromechanical device 94 as depicted in FIG. 3*b*.

As illustrated in FIG. 2*a*, if one or more of brushes 95 contact one voltage level (indicated by "+"), and at least one of the other brushes 95 contacts another voltage level (indicated by "−"), the voltage differential across the various brushes 95 is used to charge a power storage device associated with wheeled electromechanical device 94, and/or to operate a motor system associated with wheeled electromechanical device 94. This operation is further described in relation to FIGS. 4 and 5 below. Power transfer to wheeled electromechanical device 95 is provided by brushes 95 in substantially the same way described in relation to legs 26 above.

Figure 2B:
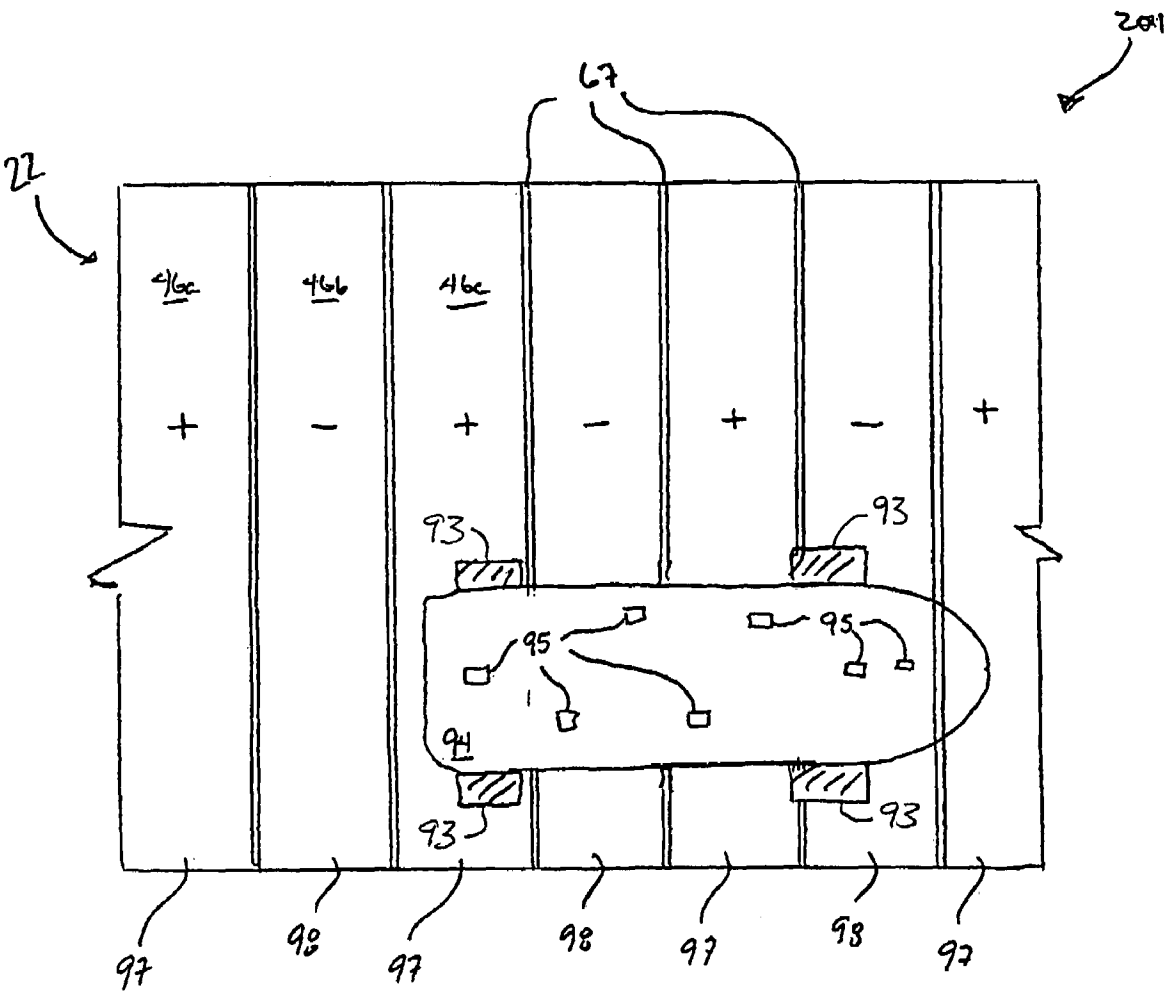

Turning to FIG. 2*b*, an alternative pattern for a power array 22 in accordance with other embodiments of the present invention is depicted as view 201. The pattern includes a number of stripe shaped pads 46 (examples of such pads are labeled 46*a*, 46*b*, 46*c*) biased at alternating voltage levels 97, 98. Power transfer from pads 46 to an electromechanical device operating on the pads is substantially similar to that discussed above in relation to power array 21.

FIG. 3 provide close-up side views 300, 301 of contact systems 100 including legged and brushed electromechanical devices 24, 94 placed thereon. Turning to FIG. 3*a*, legged electromechanical device 24 is disposed on a contact system with legs 26 in contact with power array 21. Each leg 26 includes a conductive foot 34. To avoid shorting pad 45*a* to pad 45*b*, a distance 73 across the surface of insulation region 68 is greater than the width of the portion of conductive foot 34 in contact with the surface of the contact system.

FIG. 3*b* depicts wheeled electromechanical device 94 disposed on a contact system with brushes 95 extending toward pads 45, such that brush contacts 92 touch pads 45 and/or insulation region 68. To avoid shorting pad 45*a* to pad 45*b*, a distance 73 across the surface of insulation region 68 is greater than the width of the portion of conductive brush contacts 92 in contact with the surface of the contact system. The brushes 95 are connected to a rectifier circuit 62 (not shown in the device 94, but much the same as in device 24) by wires or leads 66 (also not shown in device 94, but similar to those in device 24), which rectifies power derived from the contact system for powering the device 94. Similar connections of brushes 99 of the passive device 84 to a rectifier circuit 92 are used to power the device 84.

Figure 5:
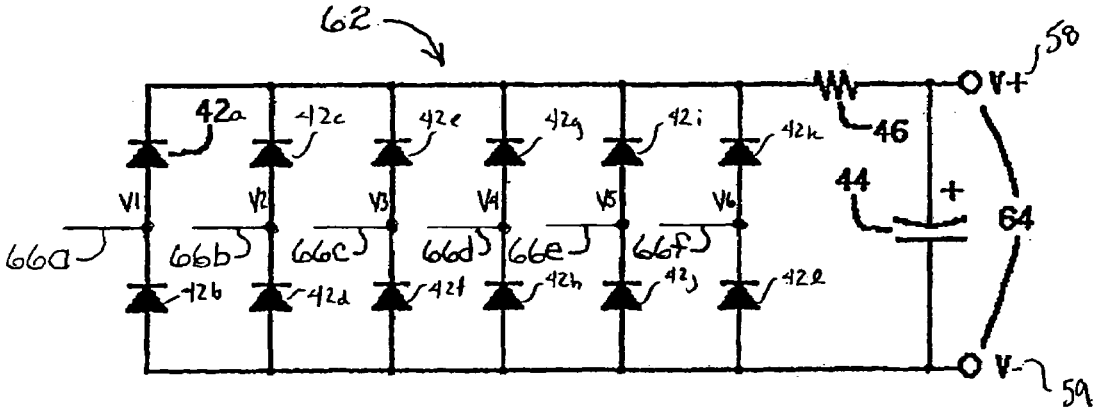
FIG. 5 is a schematic diagram of power storage element in accordance with various embodiments of the present invention.

Turning to FIGS. 4 and 5, conductive feet 34 of legged electromechanical device 24 are independently electrically connected through wires 66 to a rectifier assembly 62. Rectifier assembly 62 provides a voltage differential output 64 (e.g., the difference between $V^+$ 58 and $V^-$ 59) as more fully described in relation to the circuit diagram of FIG. 5. Wires 66 from respective conductive feet 34 attach to points on rectifier assembly 62 between respective ones of diodes 42. Diodes 42 are organized such that voltage differential 64 is positive and current flows from $V^+$ 58 to $V^-$ 59. As an illustration, assuming the "+" voltage level is greater than the "−" voltage level, voltage differential output 64 is derived where, for example, wires 66*a*, 66*b* and 66*c* are electrically connected to respective feet 34 that are each in contact with pad(s) 45 that is/are biased at the "−" voltage level, wires 66*e* and 66*f* are electrically connected to respective feet 34 that are each in contact with pad(s) 45 that is/are biased at a "+" voltage level, and wire 66*d* is electrically connected to a foot 34 that is not in contact with any pad 45. Continuing with the exemplary illustration, the voltages V5 and V6 are the "+" voltage level, the voltages V1, V2, and V3 are the "−" voltage level; and the voltage V4 is floating. Thus, $V^+$ 58 is approximately the "+" voltage level less the voltage drop across diode 42*i* (i.e., approximately the same as V6 less the voltage drop across diode 42*k*, or the same as V5 less the voltage drop across diode 42*i*). Similarly, $V^-$ 59 is approximately the "−" voltage level plus the voltage drop across diode 42*b* (i.e., V1 plus the voltage drop across diode 42*b*, V2 plus the voltage drop across diode 42*d*, or V3 plus the voltage drop across diode 42*f*). Therefore, voltage differential output 64 is the "+" voltage level less the "−" voltage level and the voltage drops across diodes 42*i* and 42*b*. A resistor 46 can also be included to limit current flow. When resistor 46 is used, voltage differential output 64 is reduced by the voltage drop across resistor 46. The following equation generically represents voltage differential output 64:

$$V_{voltage\ differential\ output\ 64} = |(V_{\text{“+” voltage level}} - V_{\text{“−” voltage level}})| - 2(V_{diode\ 42}) - V_{resistor\ 46}$$

Based on this disclosure, one of ordinary skill in the art will appreciate that any placement of feet 34 (or brushes 95 of device 94 or brushes 99 of device 84) where at least one foot 34 (or brush 95, 99) is placed on a pad 45 biased at the "−"

voltage level and at least one other foot 34 (or brush 95, 99) is placed on a pad 45 biased at the "+" voltage level, results in approximately the same voltage differential output 64. Further, based on the disclosure provided herein, one of ordinary skill in the art will appreciate other circuits capable of receiving power at different voltage potentials from two or more contacts and converting that power to a unidirectional current flow could also be used in this invention.

It should be recognized that the electrical potential at all of the points labeled V1–V6 may at times be interrupted simultaneously when the combination of conductive feet 34 do not connect with at least two pads 45 having an electrical potential difference. To alleviate interruptions in power to the electromechanical device, a capacitor 44, which can considered to be either part of, or physically separated from, the rectifier assembly 62, can be used to store charge to allow a continuous supply of power at the output 64 during these interruptions. Upon reading this disclosure, one of ordinary skill in the art will appreciate that other devices can be used in conjunction with or in place of capacitor 44, for example, a rechargeable battery. One such device may be a NiCad battery.

Transfer of power to wheeled electromechanical device 94 from contact system 100 can be substantially the same as that discussed in relation to FIGS. 4 and 5. In particular, brushes 95 can be electrically coupled to a rectifier assembly 62, as described above, to charge a storage element and/or power a motor system for receiving power from contact system 100.

Contact systems in accordance with the present invention can be tailored for use in relation to one or more independent electromechanical devices. The implementation of the contact system including the choice of pattern for the power array can be dictated to at least some degree by the proposed operational use of the contact system. For example, because brushes typically drag across the surface of a contact system, as opposed to legs that are moved from discrete location to discrete location across the surface, different designs may be desirable where brushed electromechanical devices are to be used either in place of or in conjunction with legged electromechanical devices. Where contact systems involving brushed electromechanical devices can often be designed to provide a one-hundred percent contact probability, for various reasons, contact systems involving legged electromechanical device can often be designed to provide a lower contact probability.

The following provides some general design considerations that can be employed where a legged electromechanical device is to be operated on the contact system. These general design considerations are tailored to assure a high contact probability where a legged electromechanical device is used. Application of these general design considerations result in a checkerboard layout of pads similar to that illustrated in FIG. 2*a*. Following the general design considerations, the size of the pads is adjusted and the results of the adjustment is reflected in a contact probability.

In order for current from the power source 20 to conduct charge to capacitor 44 aboard the legged device 24 (or some other power storage element), at least two feet 34 must come in contact with two pads 45 of different potential on power array 21. Various parameters affect the probability that this condition will occur while legged electromechanical device 24 moves to arbitrary locations on the contact system, assumes an arbitrary orientation in relation to the contact system; and/or with feet 34 in a random state of ambulation.

It has been found that, a regular pattern of pads 45 offers a repeatable, and thus predictable contact probability. Further, it has been found that a chosen pattern of pads 45 with a rotational symmetry often results in an optimum power array 21. Such rotational symmetry looks the same when rotated through some angle.

Pads 45 of different voltage potential can be intermixed on a size scale smaller than the span of the feet 34 of the legged device 24 to allow the greatest chance that at a given position and orientation at least two feet 34 encounter a pair of pads 45 with unlike potential. This sets a maximum size scale of each individual pad 45.

Adjacent pads 45 of differing potential can be separated by an insulating gap (e.g., a distance 73 of insulation region 67) to prevent shorting. Again, the minimum width of the gaps can be defined as more than the width of the distal end portion of a foot 34 that contacts the surface of the contact system 100 so that a foot 34 cannot create a short circuit between two adjacent pads 45. A small percentage of the surface area of contact system 100 is consumed by these insulating gaps between pads 45. The greater the percentage of surface area consumed by the gaps, the lower the likelihood of two feet 34 contacting pads 45 of different voltage levels. Therefore, to increase the likelihood of transferring power to the legged device 24, the fractional area of the gaps can be minimized by keeping the width of the gaps to a minimum that still prevents short circuiting by a foot, and by optimizing the size of the pads 45 outlined by the gaps. Depending on a number of factors, including number of feet, minimum and maximum distances between feet, and shape of the pads, the size of the pads 45 can be optimized to achieve maximum likelihood that at least two of the legs 26 will contact different voltage level pads 45 at any instant in time as the electromechanical device 24 maneuvers on the contact system 100.

To summarize this discussion, a regular, symmetric array of pads 45 is preferred, but any pattern sizes, or shapes can be used. The pad sizes and shapes can be optimized to allow the greatest likelihood for power transfer from the contact system to the electromechanical device. The pad shapes can be fit together tightly in a pattern separated by gaps just slightly larger than the width of feet 34. Further, larger pads 45 can increase their fraction of the contact system 100 of the overall surface area, but not so large as to decrease likelihood that at least two of the feet 34 will be touching pads 45 of different voltage levels, which is roughly the size of legged electromechanical device 24.

Following these general design rules and assuming pads 45 are biased at only two different voltage levels, roughly square pads arranged in a checkerboard pattern of alternating voltage levels can be chosen. Again, such a pattern of pads 45 is illustrated in FIG. 2*a*. Of course, based on the disclosure provided herein, one of ordinary skill in the art will recognized that many other patterns can be selected depending upon one or more functional desired outcomes or appearances.

An optimum size for square pads 45 can depend on the specific details of the chosen legged electromechanical device 24. For this discussion, a toy that ambulates with six legs in a unique way was used as the target device. Therefore, the resulting dimension may not be optimum for other types of devices. Nevertheless, the same numerical techniques could be applied to devices or device sets that may be utilized.

Operation of the six legged device can be simulated using one or more computer models that account for the size and layout of pads 45. The exemplary simulation data discussed below describes a six legged electromechanical device in relation to a power array 21 comprising a grid of square pads 45 arranged in a checkerboard pattern. The gaps between the various pads 45 are included in the simulation. The simulation iteratively tests whether a connection was or was not made for a set of trial placements. For each placement legged electromechanical device 24 position and orientation on power array 21 is chosen randomly. The specific legged device 24 modeled has two independent groups of three legs 26. These groups of legs are referred to as the left and right group, respectively. The groups of legs 26 move in a pattern that repeats for each revolution of a drive gear. The angle of the left drive gear and right drive gear were also chosen randomly and independently for each trial placement.

The dimensions of the critical elements of the independent electromechanical device (in this case a toy) are given in Table 1.

TABLE 1

Dimensions specifying the positions of the feet of a specific toy

| INDEX | DESCRIPTION | VALUE |
|---|---|---|
| A | Stride of each foot | 0.563" |
| B | Minor width of front and back feet | 2.397" |
| C | Major width of center feet | 2.756" |
| D | Leg to leg spacing | 0.522" |

To compute the probability of making a connection, a large number of trial placements can be made numerically. If in a particular trial a connection was made, i.e. at least two feet 34 were found to be in contact with respective pads 45 at different voltage levels, a one is assigned. If no connection was made, a zero is assigned. A sum of these results is accumulated for a large number of trials. The probability of making a connection is then computed as this accumulation normalized by the number of trials.

The simulation can be performed a number of times with different values of pad 45 size. The pad 45 size resulting in the greatest probability of connection can then be determined. From this, it can be found that an array of 1.130 inch square pads 45 with a gap width 73 of 0.020 inches between pads 45 allowed the particular legged electromechanical device 24 (in this case a toy) to complete the circuit eighty-one percent of the time in a simulation of a large number of random placements.

Since power through the legs 26 will frequently be interrupted (19% of the time according to the simulation) the rectifier array stores electrical energy in capacitor 44 so that output voltage 64 remains relatively constant. Resistor 46 limits the inrush current that would occur if capacitor 44 discharged considerably just prior to being re-connected to power supply 20 through power array 21.

As an example, consider a multi-port rectifier 62 designed for an independent electromechanical toy with six legs. Assume the toy draws 200 mA at a full speed of twelve inches/sec, resistor 46 is four Ohms, and the capacitor 44 is 0.5 F. Also assume the power source 20 provides 6.4 VDC. At full speed, the drop across resistor 46 would be 0.8 V. If the connection to power array 21 is lost, the voltage across the capacitor would drop at a rate of 0.43 volts/second. Looking at it another way, at full speed, the voltage 66 would drop by one volt in 2.35 seconds. At 12 inches/sec, it is practically one hundred percent likely that the feet will reposition to find a connection with the power pad in a fraction of a second thereby maintaining the output voltage at nearly full potential.

If capacitor 44 were fully discharged and then became connected to power array 21, resistor 46 would limit the inrush current to 1.25 A. The inrush current would fall to half that value in 1.3 seconds and to 0.25 A in 3 seconds as capacitor 44 charged.

During typical full speed operation, the gaps of intermittent power loss would be a fraction of a second so that the output voltage 64 of the rectifier assembly 62 would droop very little. When the moving feet 34 reconnect to power array 21 the inrush current would be only slightly greater than the nominal full speed current draw: about 200 mA. This modest, non-inductive contact current would cause minimal contact wear (wear of the feet 34).

At times the independent electromechanical device may come to rest in a position in which the power as interrupted due to the particular arrangement of the feet 34. If left in this configuration, the output voltage 64 of rectifier assembly 62 may drop near zero rendering the device inoperable. If the device contains intelligence or dedicated circuitry, this situation can be avoided. The device could be made to detect the connection to power array 21. In case the connection is lost, legged electromechanical device 24 could command legs 34 to reposition while the output voltage 64 of the storage device 44 of the rectifier assembly 62 is still sufficiently high to operate and move the device 24. Because of the nature of the connections to power array 21, it is likely that a small amount of repositioning will reconnect the device to power array 21.

The parameters selected in the example above, combined with intelligent repositioning, make a very practical and reliable system for seamlessly transferring power to the device. It should be noted that, while a six-legged device 24 is used as an example electromechanical device, any number or combination of legs, wheels, skids, or other components that can support the device 24 in a stable manner can also be used to implement this invention. Brushed device 94 is very similar to a legged device 24 in the way it extracts power from power array 21. Again, the number of contactors 92 connected to the multi-port rectifier assembly 62 does not have to be six. Since brushes 95 are dedicated and there is freedom to arrange them in any arbitrary fixed pattern, it is possible to find an arrangement that maintains approximately one hundred percent (or any other desired percent) power transfer probability.

Other approaches for simulating movement in relation to a contact system that can be used to design and/or optimize such contact systems are also possible in accordance with embodiments of the present invention. Some such approaches and results are set forth in U.S. Provisional Patent Application No. 60/432,072, which was previously incorporated herein by reference for all purposes.

Figure 6:
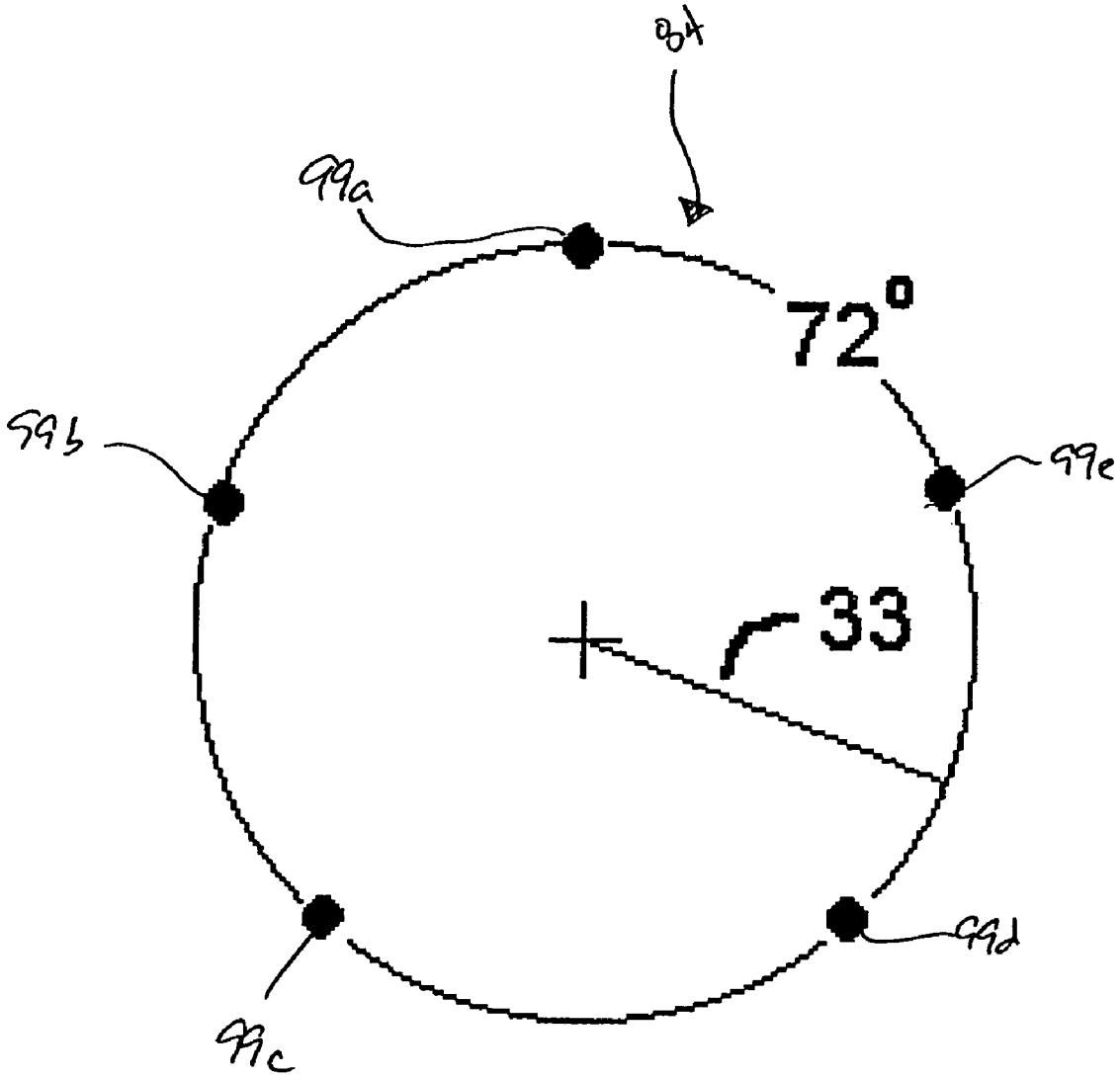
FIG. 6 is a top diagram of a passive electromechanical device showing an exemplary coupling layout in accordance with some embodiments of the present invention.

Turning to FIG. 6, the distribution of contacts on a passive device such as a puck 84 is illustrated. As illustrated in this example of FIG. 6, five contacts 99 extend out of the bottom of the puck 84 to contact an underlying contact system, for example, of the contact systems described above. This distribution of contacts 99 at an appropriate distance one from another can assure a one hundred percent chance of receiving power from the underlying contact system with pads 45 of an appropriate size and shape in relation to the puck 84, which may be important in the case of a passive device that cannot reposition itself on the contact system to get power. Such a passive device can use the received power to transmit position information to a game controller associated with the contact system.

Turning to FIG. 6, with continuing reference also to FIG. 2*a* and 5, this invention can also be used to provide electric power to devices, for example, the device 84, which are not equipped to move themselves. Such devices, which are sometimes called passive, puck, or fixed devices in this description, remain in a fixed position or place after their original placement on the contact system, as shown, for example, by the device 84 on the contact system 200 in FIG. 2*a*, unless or until they are subsequently moved by some external force. Therefore, it is desirable to maximize the probability that power will be transferred from the contact system to the device, i.e., the power transfer probability, whenever or wherever the device may be placed on the contact system, and it is possible to provide an arrangement of pads 45 and contacts 99 that ensures one hundred percent (100%) power transfer probability. The distribution of contacts on a passive devices, such as a puck 84, is illustrated. As illustrated in this example of FIG. 6, five contacts 99 extend out of the bottom of the puck 84 to contact an underlying contact system, for example, of the contact systems described above. This distribution of contacts 99 at an appropriate distance one from another can assure a one hundred percent chance of receiving power from the underlying contact system with pads 45 of an appropriate size and shape in relation to the puck 84, which may be important in the case of a passive device that cannot reposition itself on the contact system to get power.

As discussed above, at least two contacts 99 are needed to complete a circuit between two pads 45 of opposite polarity. However, as also discussed above, the electrical connection for a completed circuit will be lost or not established if one of those two contacts 99 is positioned in a gap 67 between the pads 45. Three contacts 99 will also not provide a completed circuit, if two of the three contacts 99 are simultaneously positioned in such gaps 67. Likewise, four contacts 99 will also not connect a completed circuit, if three of the four contacts 99 are simultaneously positioned in the gaps 67, and it can be shown that three contacts 99 can be positioned simultaneously in a orthogonal grid of gaps 67, such as the grid 67 shown in FIG. 2*a*, regardless of the pattern of the contacts 99. However, a grouping of five contacts 99 equally spaced on a circle of some radius 33, as illustrated in FIG. 6, i.e., a pentagon pattern, can guarantee power transfer from an array or matrix of square electrode pads 45 as illustrated in FIG. 2*a*, provided that the radius 33 of the circle on which the contacts 99 are positioned is properly chosen. In a simulation to test this hypothesis, it was found that for a matrix of square electrode pads 45 of size 1.13 inches, i.e. 1.13 inch sides, and gaps 67 of 0.02 inch in width, a range for radius 33 from a minimum of 0.605 inch to a maximum of 0.636 inch would meet the goal of providing 100% power transfer probability regardless of orientation and position of the device 84 on the contact system 200. Of course, a radius 33 sized about halfway between the minimum and maximum, i.e. about 0.62 inch, would provide the most margin for manufacturing tolerances. It is noted that this simulation did not take into account the particular gap width, as was done in the simulation discussed above for the six legged device. However, since the gap width in the example is significantly smaller than the range of workable radii, it can be assumed that the mean radius 33 of about 0.62 inch in the example will provide continuous electrical contact at any orientation or position of the device 84 with the contact system 200. An advantage of the pentagon pattern arrangement of contacts 99*a–e* on a device 84 is that no matter where the contacts 99*a–e* are deployed on the pad array of the contact system 200, power transfer to the device 84 is guaranteed without having to reposition the device 84 on the contact system 200. Of course. other contact numbers and/or distributions as well as other pad sizes and/or shapes can be used to attain desired power transfer probabilities less than one hundred percent or to attain one hundred percent power transfer probability only at certain orientations of the device on the support surface.

A passive device 84 can use the received power, for example, to transmit position information to a game controller associated with a contact system. Further, such a game controller can include two or more contacts that are placed in communication with the contact system. In this way, the game controller can derive operational power from the contact system. In one particular embodiment, the game controller is snap mounted to one side of the contact system, and the contacts associated with the game controller are placed in communication with pads on the surface of the contact system.

FIG. 7 shows a game system 1000 in accordance with various embodiments of the present invention. User input devices 1021*a*, 1021*b* are connected to a central controller 1029. Such user inputs 1021 can be, but are not limited to, joysticks, keyboards, game pads, and/or the like. Central controller 1029 can communicate commands to one or more electromechanical devices 1025 disposed on contact system 100 of game system 1000 via a radio frequency channel emitted from an antenna 1027. Central controller 1029 receives audio signals from electromechanical game devices 1025 using two or more receivers 1026A, 1026B. Such receivers 1026 can be audio receivers such as microphones, electrical receivers such as antenna, and/or the like. The position of electromechanical game devices 1025 can be sensed by central controller 1029 using sonar techniques, triangulation, interferometry, and/or other receiving and/or location techniques as are known in the art.

In a typical game scenario, some of electromechanical game devices 1025 are under user control and the remaining electromechanical game devices 1025 are under control of a game algorithm accessible by central controller 1029. In the case of those electromechanical game devices 1025 under user control, movement and other control inputs are obtained by central controller 1029, formatted, and broadcast such that the appropriate electromechanical game devices 1025 decode and uniquely respond to those user inputs.

Figure 8:
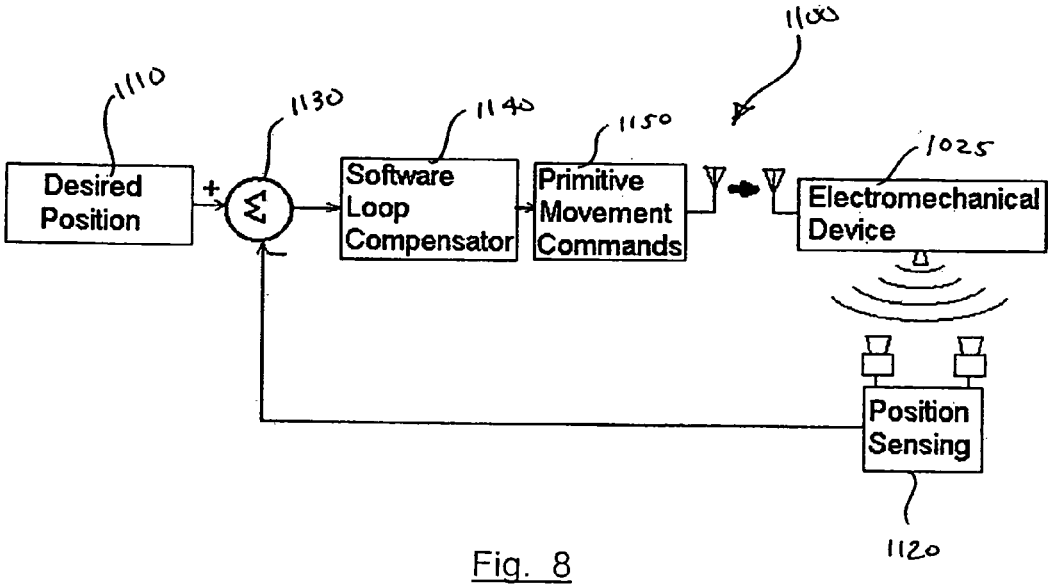

The remaining electromechanical game devices 1025 under control of a game algorithm accessible by central controller 1029 are manipulated through a closed-loop position feedback system 1100 as shown in FIG. 8. In this way electromechanical game devices 1025 under control of a game algorithm can be made to move to a particular position or a sequence of positions to form a trajectory including speed variations.

Referring to FIG. 8, desired positions 1110 (i.e. positions generated by the game algorithm) are compared with a position measurement 1120 of an electromechanical game device 1025 in a summer 1130 to form a positional error signal. An algorithm accessible to central controller 1029 converts the positional error signal to a movement command using a software loop compensator (i.e., the desired position is used to generate a movement command that operates to move the particular electromechanical game device 1025 to the desired position). The software loop compensator 1140 accounts for the dynamics of the overall control loop such that the electromechanical game device 1025 converges to the desired position with a minimum of hunting. The movement commands 1150 are formatted and transmitted such that the electromechanical game device 1025 being controlled responds to this incremental movement command. In a short time, another positional signal can be emitted by the electromechanical game device 1025, allowing the resulting position of the electromechanical game device 1025 to be measured. The process above repeats to maintain a minimal positional error signal.

As mentioned above, for a video-game-like physical game involving electromechanical elements, central controller 1029 must at a minimum know the position of each electromechanical game device 1025, and have the ability to send commands to them. However the present invention includes enhancements beyond this minimum in order to increase game capabilities.

The amount of sophistication that can be used in a game scenario can be related to the amount of information central controller 1029 can obtain about electromechanical game devices 1025. For example, if the orientation of an electromechanical game device 1025 can be known, in addition to its position, then the game can include responses appropriate to that orientation. For example, a virtual laser can be fired in a meaningful way by one of the electromechanical game devices 1025 (in the context of a game), provided central controller 1029 can estimate the intended pointing direction.

The orientation of a particular electromechanical game device 1025 can be derived from successive measurements of its position and knowledge of the motion commands sent to it. Knowledge of position alone is not sufficient since an electromechanical game device 1025 may be capable of changing its orientation without changing its position, i.e. the electromechanical game device 1025 may have the ability to spin in place. This issue is addressed by routing all commands from the user inputs 1021 and from a central processing unit associated with central controller 1029 through a single transmit channel.

Figure 9:
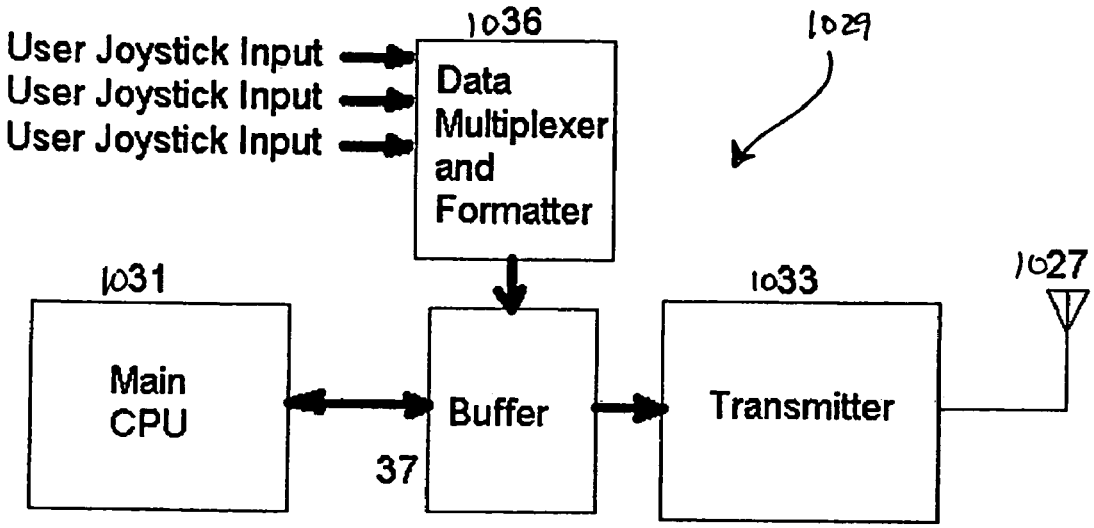

FIG. 9 is a block diagram of the transmission portion of central controller 1029. Central controller 1029 includes a central processing unit (CPU) 1031, a buffer 1037, a data multiplexer and formatter 1036, a transmitter 1033, and an antenna 1027 connected to transmitter 1033. CPU 1031 is connected to buffer 1037, and buffer 1037 is further connected to the data multiplexer and formatter 1036 and transmitter 1033.

In operation, user inputs are received in data multiplexer and formatter 1036 and are passed to buffer 1037. CPU 1031 operates on the user inputs while they are held in buffer 1037. CPU 1031 can therefore modify the user inputs, and can employ the user inputs in creating movement commands. The resulting movement commands are passed to transmitter 1033 through buffer 1037, and are transmitted to electromechanical game devices 1025 by transmitter 1033. In this way, CPU 1031 can monitor user inputs, can monitor and manipulate commands sent to electromechanical game devices 1025, and can send various commands to electromechanical game devices 1025 under software control.

Figure 10:
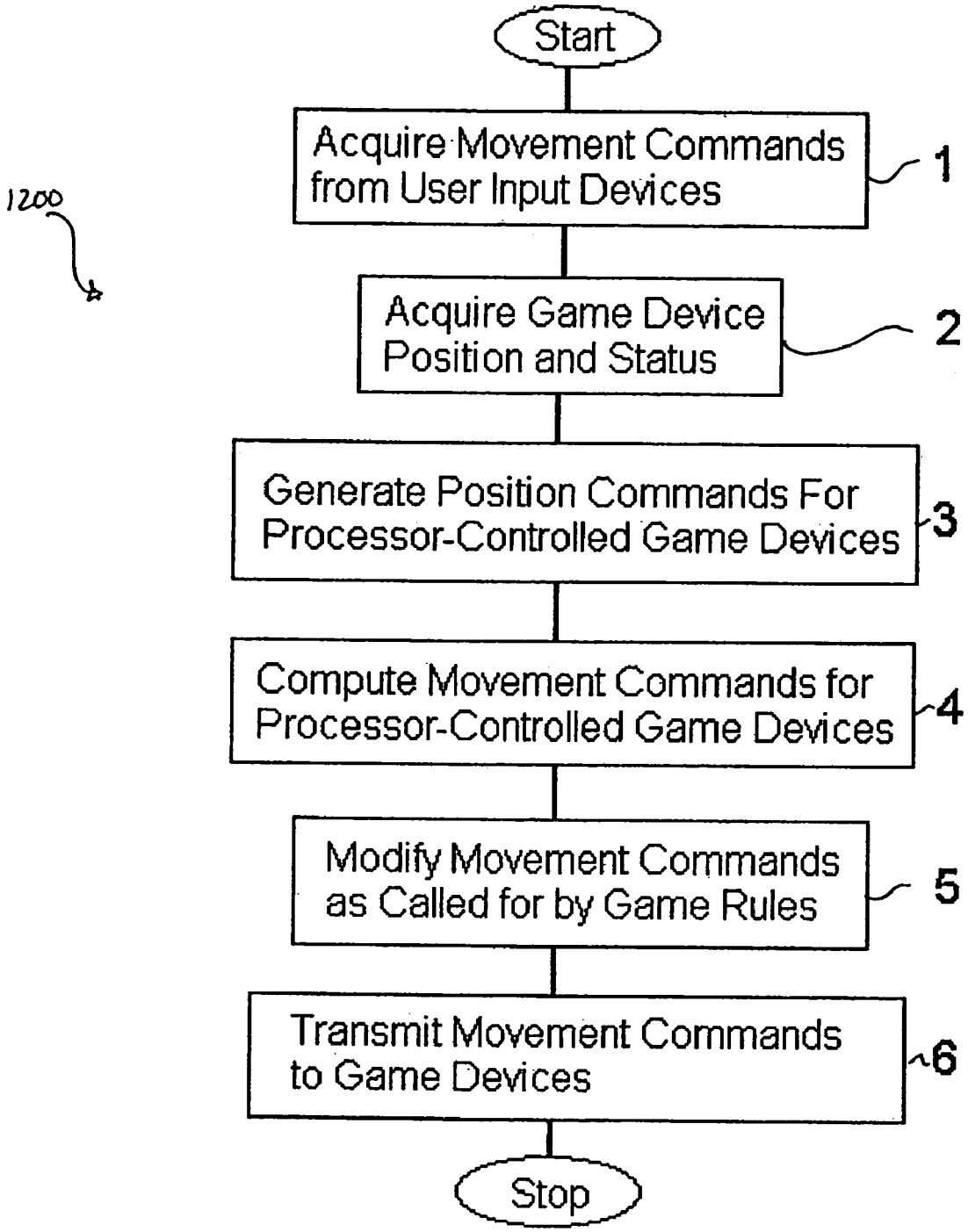

FIG. 10 is a flowchart 1200 that illustrates one pass of an iterative method according to one embodiment of the invention. To start, in step 1 the central controller obtains user inputs from the user input devices 1021. For example, the user inputs can comprise user movements transmitted through and obtained from a joystick, button, wheel, or other user input device. The user inputs can be obtained from multiple user input devices 1021 connected to or otherwise in communication with central controller 1029 (see FIG. 7).

In step 2, central controller 1029 acquires and updates the current position and status for each electromechanical game device 1025. The position and status in one embodiment can be measured at each iteration of the feedback and control loop, or can be measured whenever a position report command can be issued to any of electromechanical game devices 1025. In one embodiment, central controller 1029 determines and updates multiple electromechanical game device positions with each iteration.

In one embodiment, central controller 1029 issues a radio frequency (RF) position report command. The position report command prompts one or more electromechanical game devices 1025 to respond, and a positional fix can be obtained from the response. In one embodiment, the position report command is broadcast to all of electromechanical game devices 1025 but is addressed to only one. In response, the addressed electromechanical game device 1025 generates an audio signal (i.e., a chirp) that central controller 1029 receives through the receivers 1026A, 1026B. Central controller 1029 uses the received audio signal (and a position-computing algorithm) to perform ranging and triangulation operations in order to determine position. Alternatively, more than one electromechanical game device 1025 can receive and respond to the position report command.

In step 3, central controller 1029 determines the next desired position for each electromechanical game device 1025 under computer control, using a game algorithm. The game algorithm uses as inputs the user inputs from the user input devices 1021 and the current game device positions, orientations, times, and states.

In step 4, in one embodiment a position servo algorithm implementing the closed-loop control system of FIG. 8 computes incremental movement commands to be transmitted to electromechanical game devices 1025 under computer control. The positional measurements of step 2 are subtracted from the desired positions of step 3 to generate an error signal. A software loop compensator processes the error signal to generate primitive incremental movement commands that, when and if executed by the electromechanical game device 1025, will tend to minimize the difference between the position specified in step 3 and that measured in step 2. The incremental movement commands are stored in buffer 1037 for subsequent transmission (see FIG. 9).

In step 5, in one embodiment the game algorithm determines whether any movement commands should be modified. The movement commands can be modified by the game algorithm so as to conduct the game in a certain way. For example, a game device 1025 of a particular player can be rendered inactive or dead for a period of time, or the user's inputs can be modified during the game. Consequently, the user inputs may not necessarily be passed straight through to electromechanical game devices 1025, but can be modified, delayed, blocked, etc., according to the game. It should be understood that central controller 1029 can modify the user inputs in any way. In addition, CPU 1031 may modify the movement commands generated in step 4 for electromechanical game devices 1025 under computer control. As an example, the movements may be frozen if the electromechanical game device crosses a boundary of the playing area through overshoot of the position servo loop or when a static position has been reached within an acceptable distance.

In step 6, central controller 1029 transmits the movement command (or the set of movement commands) to the respective electromechanical game device or devices 1025. The transmission can be a wireless transmission, and can comprise RF transmission, infrared (IR) transmission, ultrasonic transmission, etc.

In one embodiment, the movement commands are broadcast to all of electromechanical game devices 1025. In another embodiment, the movement commands can be targeted to specific electromechanical game devices 1025, such as by code division multiple access (CDMA), time division multiple access (TDMA), frequency division multiple access (FDMA), or any other method. Likewise, any other information can be transmitted to electromechanical game devices 1025, such as initialization information, initialization commands, overall system commands, etc.

In an embodiment, user inputs are considered as desired inputs and can be intercepted and modified by central controller 1029 before being sent to an electromechanical game device 1025. As an example, game rules may call for an electromechanical game device 1025 to be rendered immobile for a period of time. During this time central controller 1029 ignores the user inputs and forces the primitive motor commands for that particular electromechanical game device 1025 to zero. Likewise, a user-controlled electromechanical game device 1025 could be made to act sluggish or erratic, or to simulate great momentum.

A novel feature of this invention is that electromechanical game devices 1025 are given very little intelligence by design. The intended commands are primitive, such as to control the speed of the various motors in the device. With time, control algorithms in the central controller are likely to improve. In addition, it is likely that new features and capabilities will be implemented to reflect new game requirements. Electromechanical game devices 1025 that respond only to primitive commands will remain compatible and reflect the increased capabilities as this evolution progresses.

One feature of the embodiment is the ability for electromechanical game devices 1025 to communicate information back to central controller 1029. This information can contain, but is not limited to, sensory input, status information, and ID number. The sensory input could reflect input from a proximity detector, or a feeler-actuated switch closure. Status information could contain such information as power supply status, remaining memory, or possibly game related parameters such as number of seconds remaining, and/or the like. An identification number may also be transmitted indicating the type of electromechanical game device 1025 and its unique identity.

Another feature of the embodiment is that electromechanical game devices 1025 can be powered by an inexhaustible power source. Video-game-like play with remote electromechanical game devices 1025 captures player's attention for hours at a time. However, since electromechanical game devices 1025 consume power it is undesirable that they operate from an expendable source such as primary batteries. For this reason the embodiment of this invention includes a means of providing an unlimited source of power to electromechanical game devices 1025. The method employed in the embodiment uses direct electrical contact from an energized array of electrodes on the playing surface 22 through legs or brushes on electromechanical game devices 1025.

The acoustic burst used for position sensing and communication is audible in one embodiment of this system, and measures can be taken to prevent it from being objectionable. In one embodiment, the periods between bursts are randomized. In addition, in one embodiment electromechanical game devices 1025 are formed in a bug-like appearance and so would be naturally compatible with the random clicking sound that can be heard. It should be understood that electromechanical game devices 1025 can be formed in many shapes, and can resemble animals, persons, video game characters or objects, cars or other vehicles, etc.

In the embodiment a system of dynamic addressing can be used, whereby electromechanical game devices 1025 can be assigned unique addresses dynamically without the use of switches. In this way, any set of electromechanical game devices 1025 can be run in combination without manual reconfiguration.

Dynamic addressing can be a simple matter in consideration of a single electromechanical game device 1025, powering-up from the off state. In this case, the electromechanical game device 1025 initializes with a predefined default address. Central controller 1029 would recognize a device 1025 responding to this address, and assign a new address to that device 1025.

However, a difficulty arises in the case where more than one electromechanical game device 1025 powers-up simultaneously. In this case, all devices responding to the default address would be simultaneously re-assigned the same new address. What can be needed is a method to distinguish electromechanical game devices 1025 responding to the same default address.

This problem can be solved by a combination of position sensing and random response statistics. By design, electromechanical game devices 1025 are made to respond to the default address with random statistics. Specifically, when requested to emit a positional signal, electromechanical game devices 1025 with the default address will only sometimes respond.

In this method, central controller 1029 focuses on a particular electromechanical game device 1025 responding to the default address based on its measured position until its new address has been assigned. For each positional signal that can be randomly emitted from that particular electromechanical game device 1025 at only its specific position, the central controller transmits an acknowledgment. After some time, that and only that specific electromechanical game device 1025 at that position will be able to distinguish itself as the device in focus. Other electromechanical game devices 1025 at the default address but at other positions will not recognize themselves as being the focus since their random transmissions were not reliably echoed. At that point, a unique address can be assigned to the electromechanical game device 1025 in focus. The focus then shifts to the next electromechanical game device with the default address but at another specific position.

Another issue to be addressed in a system with dynamically assigned addresses can be that the user input devices 1021 must be properly associated with the desired electromechanical game device 1025 in which it is supposed to control. In the embodiment the association can be accomplished by a method called "hypnosis".

A player "hypnotizes" the desired electromechanical game device 1025 by holding the input device 1021 in close proximity to it and depressing a "hypnosis" button. In this mode, the input device 1021 detects the positional signal emitted by the electromechanical game device 1025. This gives the system sufficient information to determine the address of the desired electromechanical game device 1025. From that point forward, central controller 1029 will route commands from that particular input device 1021 to that specific electromechanical game device 1025 completing the association.

The foregoing method of dynamic addressing and "hypnosis" can be used in the embodiment. However, other techniques could be used. For example, a manual addressing system would use a multi-position switch to set the addresses on both electromechanical game devices 1025 and the input devices 1021. The input device 1021 set to a particular address would be associated with and in control of the electromechanical game device 1025 manually set to the same address.

In one particular embodiment, receivers 1026 are microphones 2026, and the control is performed via ultrasonic communication signals. Further, electromechanical devices 1025 can be either devices movable on their own power and/or passive devices movable only with application of external force. For the purposes of this discussion, such electromechanical devices are generically referred to as remote devices, communications from central controller 1029 to remote devices 1025, and position sensing of remote devices 1025 are accomplished by the method of this invention. A unique feature of this invention is that these three functions are implemented in concert with one another. In other words the various constituents of a particular embodiment simultaneously provide multiple functions. Although this is not a necessary requirement of the invention, it may make for a more economical solution.

Figure 11:
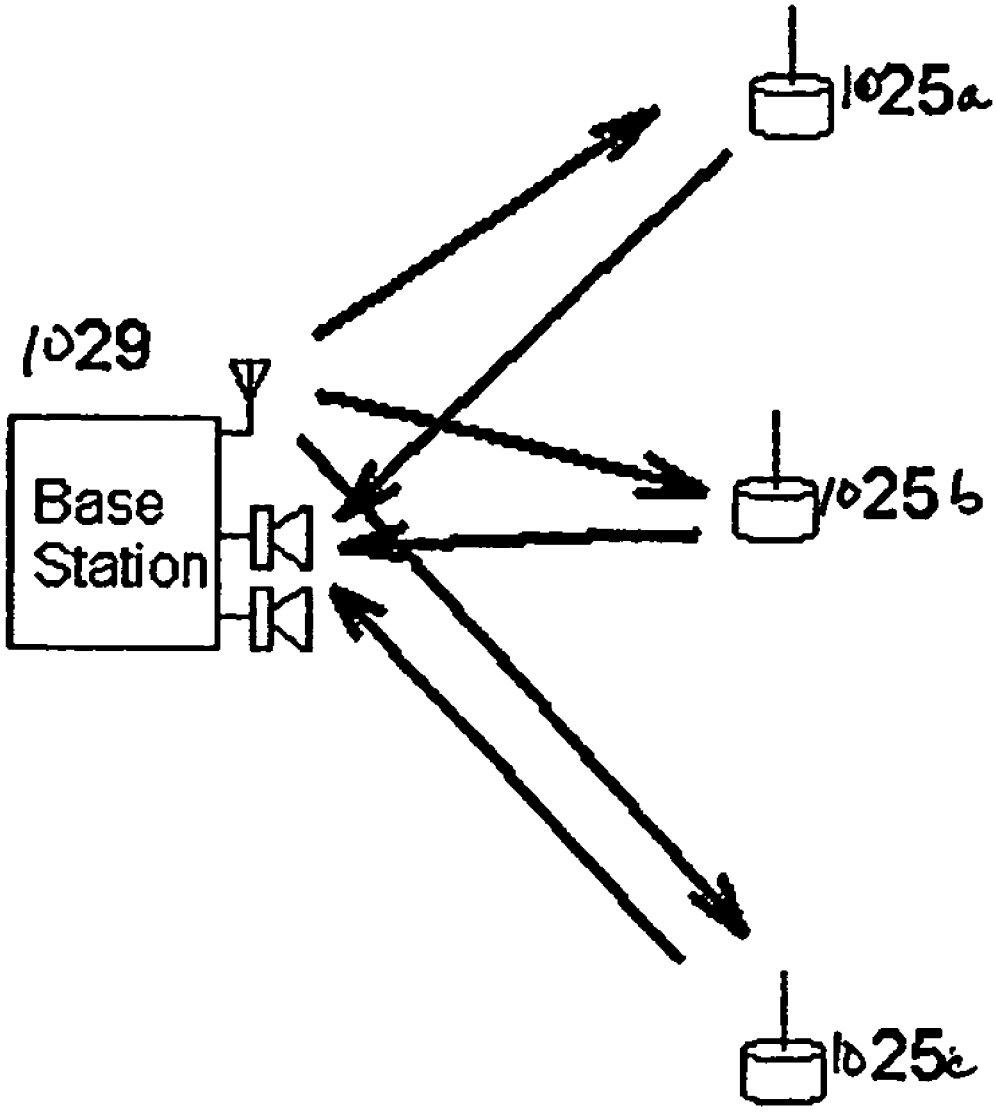
FIGS. 11–26 illustrate a game system controller in accordance with some embodiments of the present invention.

Communication between the various elements of the system is shown generally in FIG. 11. Central controller 1029 provides a single frequency radio transmitter 35 (see FIG. 12) that simultaneously transmits (i.e., broadcasts) to one or more other remote devices 1025. Each remote device 1025 can be pre-assigned a unique address. In one embodiment, a protocol employing both direct addressing and time slot addressing is used so that a message from central controller 1029 can be uniquely sent to a specific remote device 1025.

Central controller 1029 can transmit a command that causes a specific remote device 1025 to emit a time-synchronized acoustic burst. Central controller 1029 receives the acoustic burst with the two microphones 2026*a* and 26*b*. The time of arrival of the burst is measured to each microphone 2026*a*, 2026*b* and is used by central controller 1029 to determine the location of remote device 1025. In addition, in one embodiment the audio burst carries one bit of information from remote device 1025 to central controller 1029.

Figure 12:
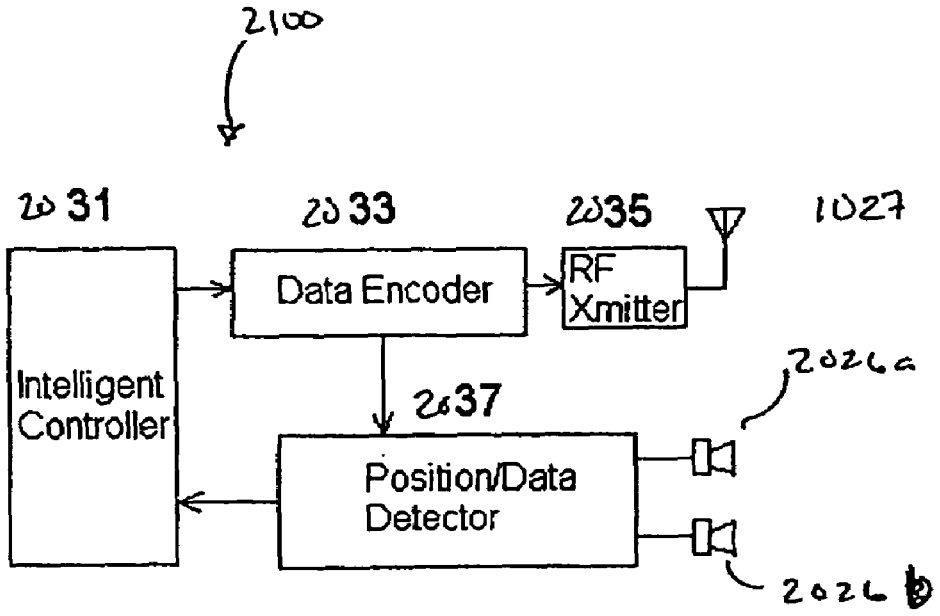

FIG. 12 is a block diagram 2100 of a particular embodiment of central controller 1029, comprising an intelligent controller 2031, a data encoder 2033, an RF transmitter 2035, two microphones 2026*a* and 2026*b*, and a position/data detector 2037. An intelligent controller 2031 generates the commands to be sent to the remote devices. In an embodiment, intelligent controller 2031 exists as a set of subroutines in a central processing unit (CPU). The remaining computing power of the CPU performs much of the functions of the other blocks in FIG. 12.

Data encoder 2033 receives intended message bytes from the CPU and converts the intended message bytes to a Manchester pulse code modulated (PCM) serial data stream. As described below, Manchester coding combined with the specific data sequence of this invention allows for efficient clock recovery at the receiver as utilized by the acoustic ranging technique employed. Data encoder 2033 can modulate the radio frequency (RF) carrier with 100% AM modulation by keying the RF transmitter 2035. This is also sometimes referred to as on-off keying (OOK).

Figure 13:
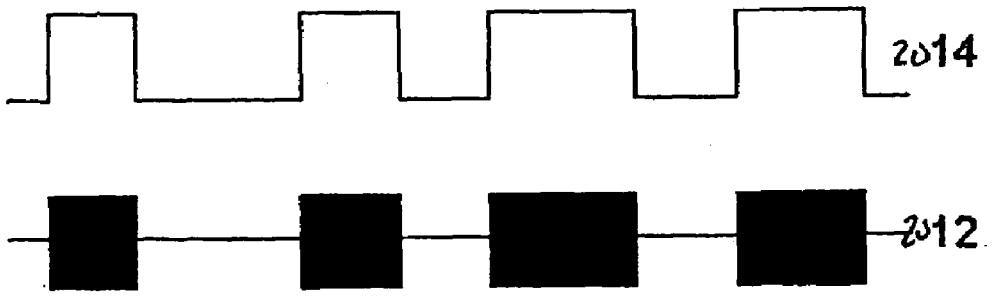

FIG. 13 shows a serial data stream and the resulting RF carrier signal that is transmitted by central controller 1029. A digital "1" value in the serial data stream 2014 modulates the RF carrier 2012 to fully on and a digital "0" value in the serial data stream 2014 modulates the RF carrier 2012 to fully off. Referring again to FIG. 12, position/data detector 2037 processes the received signal from two microphones 2026*a*, and 2026*b* and communicates the results to intelligent controller 2031.

The data format used by central controller 1029 to communicate with the remote devices in one embodiment will now be described. Those skilled in the art could devise other acceptable formats. This description is not intended to limit the present invention to a specific format. Instead it is intended to describe one embodiment and help illustrate the method of this invention.

Figure 14:
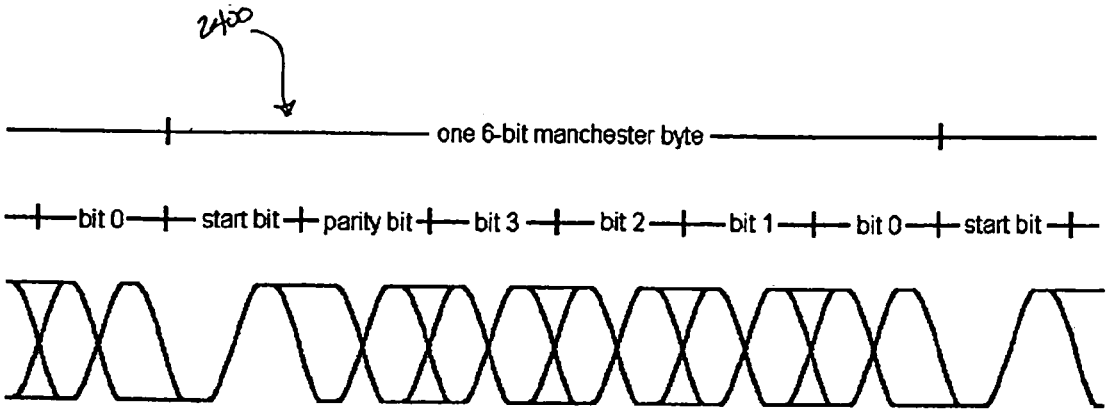

FIG. 14 shows a bit format 2400 used in each byte of the detected Manchester data stream, according to one embodiment of the invention. The information can be transmitted in a sequence of serial bytes, each comprised of six bits. The bits are defined as follows:

| 5 | 4 | 3 | 2 | 1 | 0 |
|---|---|---|---|---|---|
| S | P | D3 | D2 | D1 | D0 |

D0, D1, D2, and D3 represent sixteen possible four-bit binary numbers constituting the information sent. P is a parity bit used for error detection, and S is a start bit, which is always set to digital "1" value. A sequence of twelve bytes constitutes a data frame.

Figure 15:
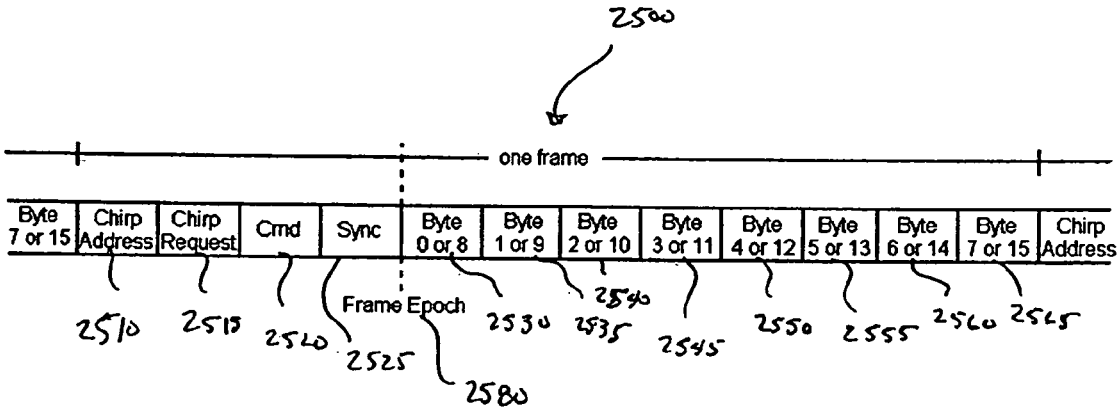

FIG. 15 shows the format of a single data frame 2500 comprising twelve bytes. The bytes of a frame are defined as follows:

Byte 0) Chirp address 2510
Byte 1) Chirp request 2515
Byte 2) Command 2520
Byte 3) Sync 2525
Byte 4) Data for device 0 or 8 2530
Byte 5) Data for device 1 or 9 2535
Byte 6) Data for device 2 or 10 2540
Byte 7) Data for device 3 or 11 2545
Byte 8) Data for device 4 or 12 2550
Byte 9) Data for device 5 or 13 2555
Byte 10) Data for device 6 or 14 2560
Byte 11) Data for device 7 or 15 2565

The bytes and the frames they comprise are sent repetitively without gaps such that bit transitions occur synchronously with a steady clock. Likewise the beginning of each frame occurs at a steady and predictable rate. The duration of each bit is 352 microseconds, the duration of each byte is 2.112 milliseconds, and the duration of each frame is 25.344 milliseconds. The predictable and steady nature of the data stream enables remote device 1025 to recreate a local frame sync signal with an accuracy of +/−5 us. An uncertainty of +/−5 us in a measurement of the time of arrival will introduce a distance measurement uncertainty of about $1/16^{th}$ of an inch.

A frame epoch 2580 shown in FIG. 15 defines the time at which an acoustic signal is to be emitted, when appropriate. Since the constituent bytes of the frame are synchronous to a steady clock, then as a result the frame epochs occur at a steady rate. For the base station, the frame epoch is considered as the zero time reference point for measuring the time of arrival delay.

Each remote device receives the data stream and synchronizes to the byte boundaries and frame boundaries. A software counter steps to keep track of the byte count referenced to the beginning of each frame.

Figure 16:
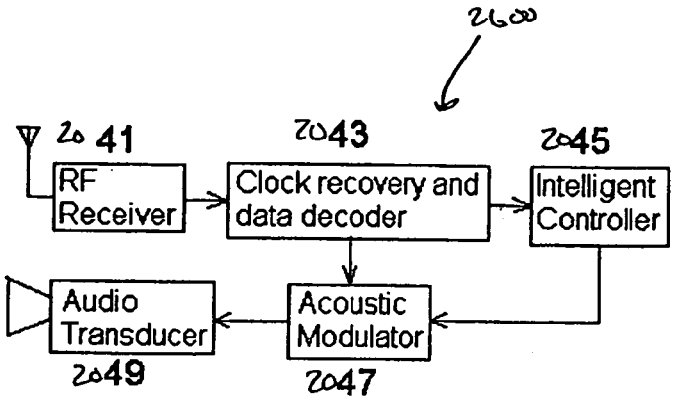

FIG. 16 is a block diagram 2600 of a remote device 1025 comprising an RF receiver/detector 2041, a clock recovery and data decoder 2043, an intelligent controller 2045, an acoustic modulator 2047, and an audio transducer 2049. The RF receiver 41 detects the modulated RF carrier 12 (see FIG. 13) to recreate a local copy of the serial data stream 2014. In one embodiment, the RF receiver 41 is a single transistor super-regenerative receiver/detector followed by an alternating current (AC) amplifier. An AC coupled amplifier can be used since the Manchester serial data stream 2012 contains no DC component. However, it should be understood that other types of RF receivers can be used.

A Manchester clock recovery and data decoder 2043 derives the transmitted data as well as a local copy of the base station's clock and frame sync.

The received data is made available to an on-board intelligent controller 2045 that interprets commands sent by central controller 1029. When commanded to do so, intelligent controller 2045 initiates an audio response by generating one of two predetermined serial codes representing either a mark or space. The acoustic modulator 2047 bi-phase modulates a carrier signal with the chosen serial code. The carrier signal (and the serial code) is synchronized to the master clock in central controller 1029.

An audio transducer converts the bi-phase modulated carrier signal to an acoustic signal that radiates with substantially equal intensity in all directions along the two-dimensional surface on which remote device 1025 rests (see FIG. 7).

When the Chirp Request byte is broadcast, each remote device 1025 checks the value against its assigned address. If it is a match, a flag is set so that an audio burst will be generated by that remote device 1025 at the next frame epoch. Each remote device 1025 is assigned it's own unique address, such as values from 0 to 15. Each remote device 1025 receives and decodes all of the information sent by central controller 1029 in a frame-by-frame manner.

Figure 17:
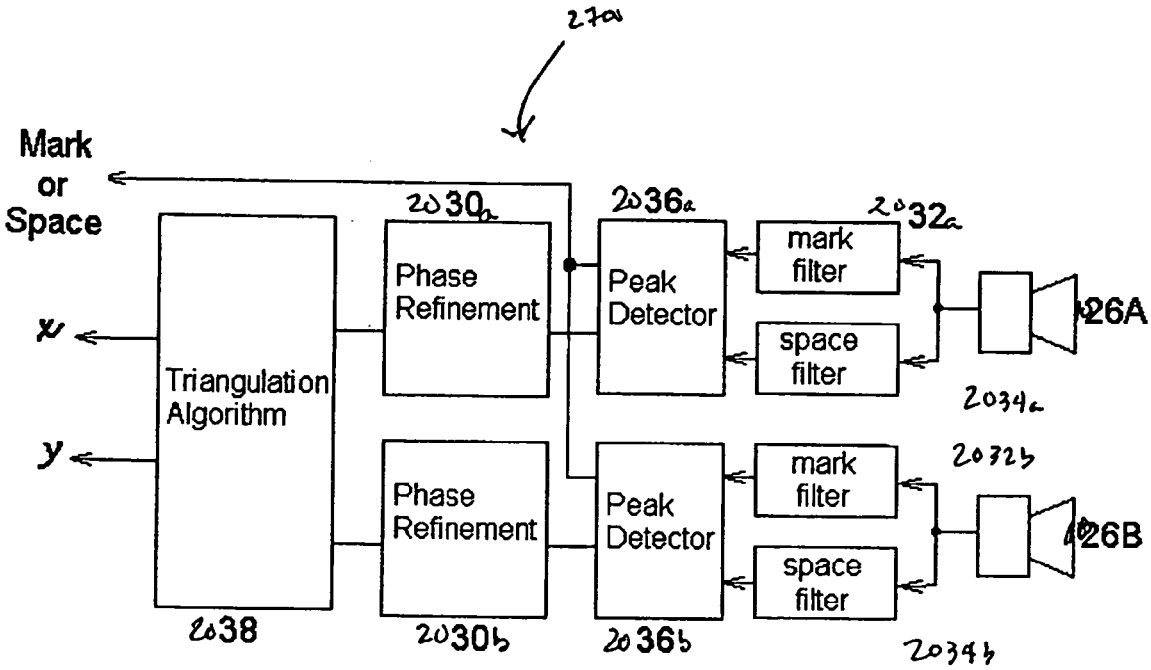

FIG. 17 is a block diagram 2700 of the position/data detector 2037, comprising a triangulation algorithm 38, and two identical audio receiver channels each comprising a microphone 2026, a mark filter 2032, a space filter 2034, a peak detector 2036, and a phase refinement function 2030. Each microphone 2026*a* and 2026*b* is connected to one of two identical receiver channels. For each channel, the signal from the microphone (1026A or 1026B) is filtered simultaneously by a mark filter 2032 and a space filter 2034. Mark filter 2032 has a large response for the mark signal and a small response for the space signal. Likewise space filter 2034 has a large response for the space signal and a small response for the mark signal.

Peak detector 2036 determines the largest of the signals from the mark 2032 and space 2034 filters on a given channel. This determines one bit of data communicated back from remote device 1025. In addition, it stores the time the peak was detected. The difference between the time of emission and the time of the peak determines by direct proportion the distance between audio transducer 2049 and the given microphone 2026*a* or 1026B.

Figure 18:
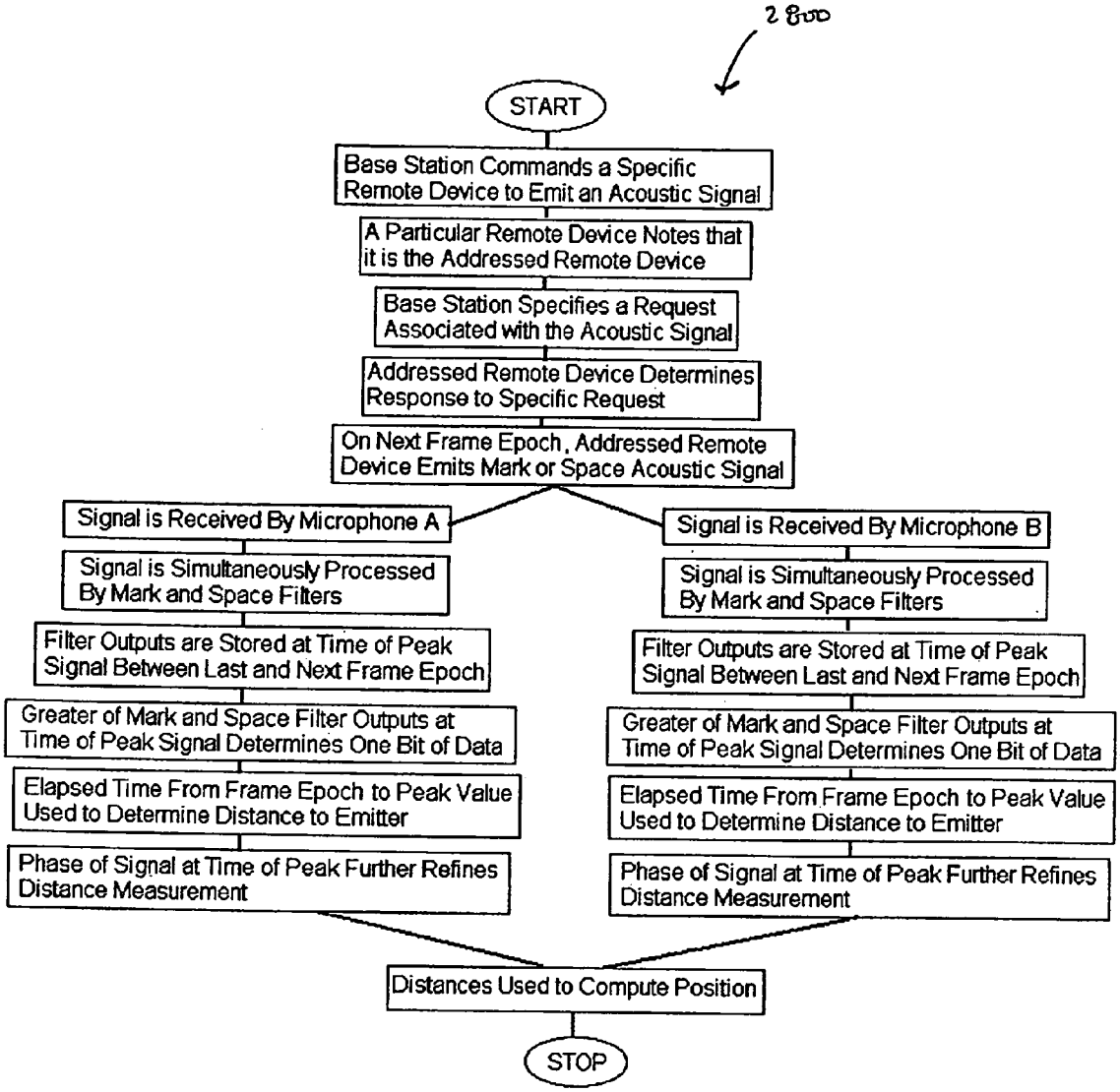

FIG. 18 is a flow chart 2800 detailing the sequence of steps that occur to derive the position of a remote device. Central controller 1029 begins the sequence by setting byte 0, Chirp Address, to the address of the specific remote device to be measured. Remote device 1025 detects this intent and waits for the information to be sent in Byte 1. Central controller 1029 then sends Byte 1, Chirp Request, to specify a query of a list of pre-defined queries in which remote device 1025 is to respond with a single bit of data. Upon reception of the Chirp Request, remote device 1025 determines the appropriate response to the particular pre-defined query. On the next frame epoch, that is at the boundary between bytes 3 and 4 (see FIG. 15), remote device 1025 initiates the transmission of the acoustic signal.

At various times after the frame epoch, the acoustic signal will arrive at the two or more microphones 2026*a* and 2026*b*, which are located in a predetermined geometrical configuration. The flow chart illustrates a system using two microphones, but the concept can be extended to more than two microphones in order to either increase the number of unambiguous spatial dimensions, to increase the accuracy or reliability of the measurement, or both. The signal from each microphone is processed as shown in the two parallel columns of FIG. 18.

For each microphone, the signal is received and simultaneously processed by a mark and space filter. The value of the filter outputs is compared against a peak. For each sample in which the peak of one of the filters is greater than the latest peak, a new peak is declared. The values of the outputs of the mark and space filters are stored at the time of each peak. At the time of the next frame epoch, the latest peak is declared to be the peak for that emission.

The values of the mark and space filters (stored for the highest peak in that interval) determine, by direct comparison, the one-bit response to the Chirp Request query. The time associated with the peak determines the course time of arrival of the signal and, therefore, the course distance from the remote device. Lastly, the phase of the signal at the peak is used to refine the distance measurement for that microphone. The set of distances measured to each of the microphones and the knowledge of the geometrical configuration of the microphones is used to compute the position of remote device 1025.

Figure 19:
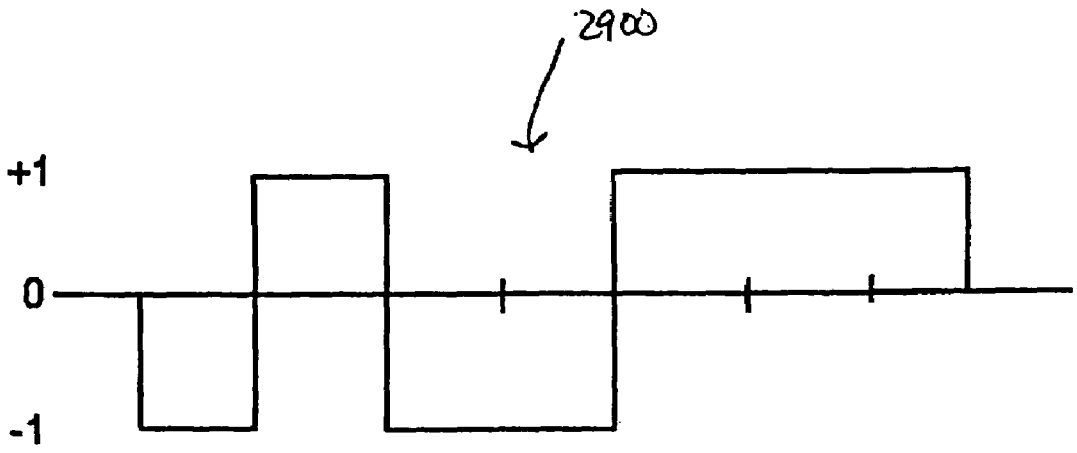
Figure 20:
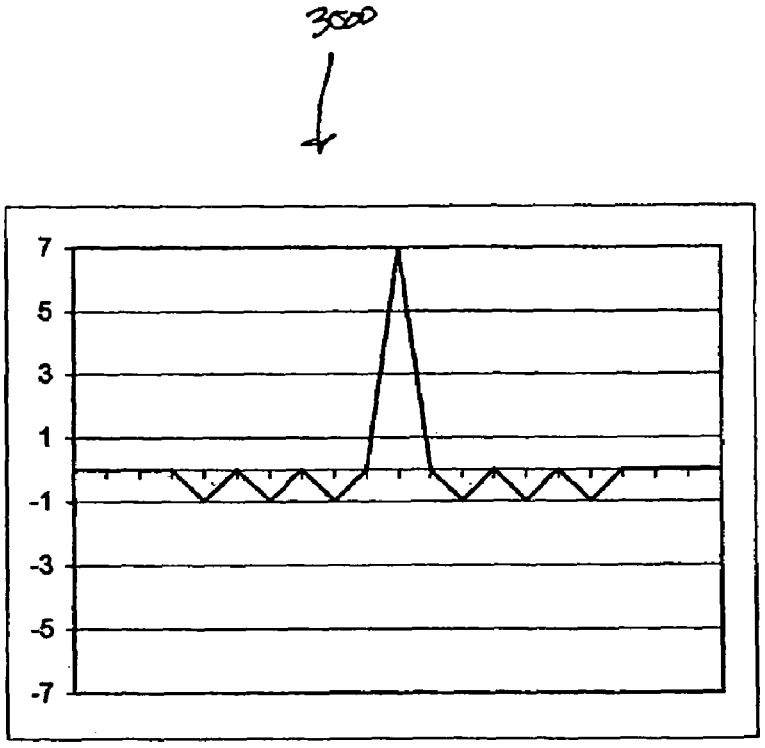

The mark and space codes that modulate the audio carrier belong to a special class of codes. A class of n-bit codes, called Barker pulse-compression codes, has the unique property that when received by a Barker pulse compression code matched filter (herein also referred to as a Barker filter), the output is strongly peaked at one time and near zero at all other times. FIG. 19 shows a 7-bit Barker code 2900 and FIG. 20 shows an output 3000 of its Barker filter in response to it. Herein, each bit of the code is sometimes referred to as a chip. If the length of the 7-bit code is T seconds, then the half-voltage width of the main peak is T/7 seconds—thus justifying the name "pulse compression". The properties of this class of codes are well known to those skilled in the art of radar technology. The appropriate matched filter can be implemented in software as a finite impulse response (FIR) filter operating on a series of digitized samples of the received signal.

In a practical system the ideal response of FIG. 20 cannot be realized primarily because of finite system bandwidth and amplitude and phase non-linearities in the audio transducers. Typically, these problems would render the peak more rounded than that shown in FIG. 20. A rounded peak is difficult to accurately detect in the presence of noise, as is always found in a practical system. To make optimal use of inexpensive, readily available audio transducers, the code is used to modulate an audio carrier centered at a frequency band that can be accurately reproduced by these transducers. The modulation process centers most of the energy of the signal about the frequency of the carrier.

Figure 21:
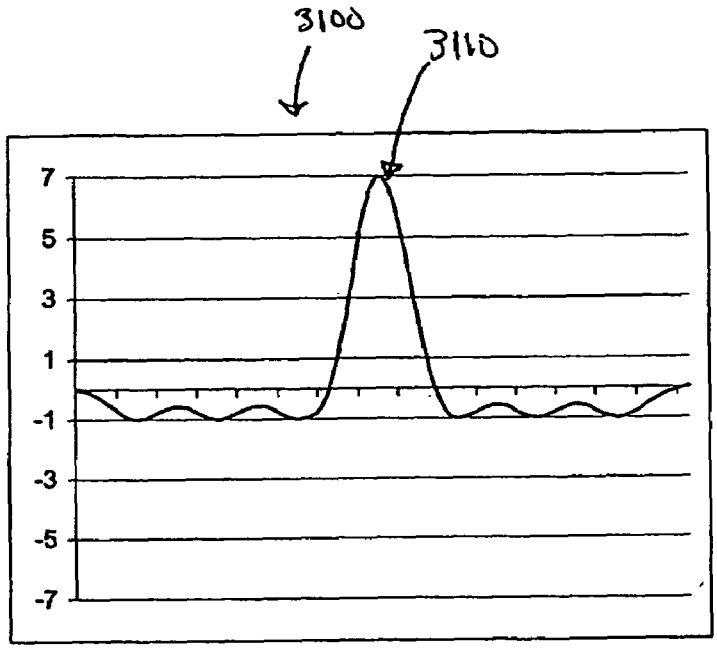

One method of detection uses a base band demodulator followed by a Barker filter. Given the inherent system bandwidth limitations, the signal emerging from the Barker filter may look like that of FIG. 21. Such a rounded peak 3110 as shown causes difficulty for a peak detector since fluctuations due to noise may cause an adjacent value to exceed the desired peak. An error in the peak detection translates directly to an error in the distance measurement.

In this application, additional information about the signal is known and is exploited to improve the performance in the face of this problem. The phase relationship between the audio carrier and the Barker code modulation is fixed, unlike the analogous constituents of radar or sonar echoes. For this reason, a measurement of the received phase can be used to correct small errors in peak detection.

The distance d being measured can be expressed as an integer number n of wavelengths $\lambda$ plus a fractional part $\alpha$ where $0 \leqq \alpha < 1$ giving $d=\lambda(n+\alpha)$. The fractional part $\alpha$ is derived directly from the received signal phase $\phi$ by $\alpha=\phi/2\pi$. The peak detector must determine the distance d with accuracy great enough to determine the appropriate integer it. The phase $\phi$ can then refine the measurement of the distance d to high accuracy.

The method works as long as the errors in peak detection correspond to phases less than $\pm\pi$. If this is not true, then it cannot be said that the peak detection accuracy is great enough to determine the appropriate integer n. Peak detection is more able to meet this requirement as the number of cycles of the audio carrier in each chip of the Barker modulation is reduced. In a particular embodiment, each chip of the Barker modulation has duration of two cycles of the audio carrier. The entire 7-bit Barker modulated code, therefore, has duration of 14 cycles of the audio carrier. This resulting signal is shown as diagram 3200 of FIG. 22. A transducer with relatively low Q is required to accurately reproduce such a signal. (Q is the ratio of the center frequency to bandwidth).

For this waveform, and using the most standard method of detection (as supposed above), peak detection must be accurate to a time corresponding to half a cycle of the audio carrier. In the best case, that is with unlimited system bandwidth, the slope of the peak is such that it's amplitude changes by 25% of the peak value in that time. This means that noise with amplitude of 25% of the peak value could cause an error resulting in improper selection of n.

There is another method that further exploits the fact that the phase relationship between the audio carrier and the Barker code modulation is fixed. In the particular embodiment the signal is detected directly by a filter matched to the known particular relationship between the phase of the audio carrier and the Barker code modulation. This filter is not a Barker filter but has similar characteristics. Herein this filter will be referred to as the modulated matched filter.

Figure 22:
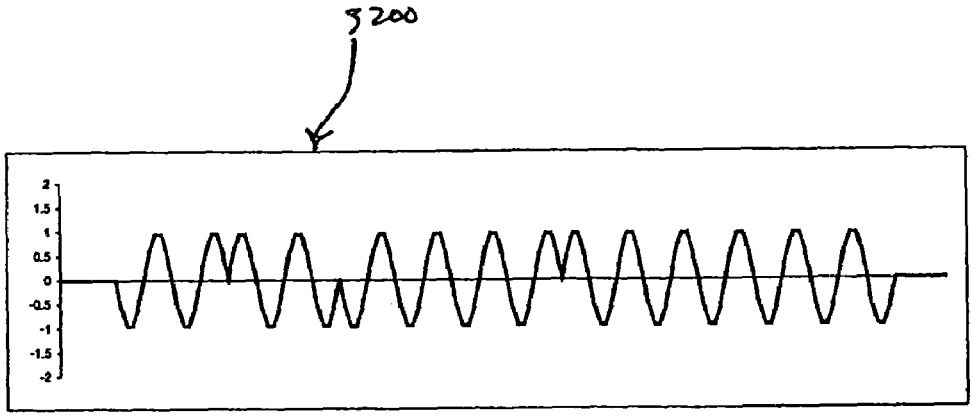
Figure 23:
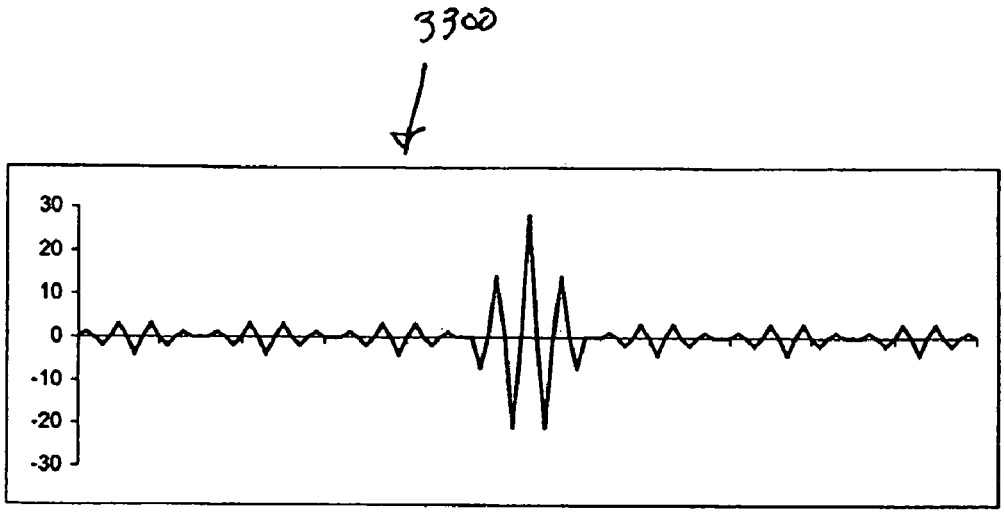

FIG. 23 includes a diagram 3300 that shows the response of the modulated matched filter to the waveform of FIG. 22. The use of the modulated matched filter offers two significant advantages over the obvious method mentioned above. It is computationally more efficient and it is much more peaked. The sharp peak makes for very reliable peak detection. This method greatly reduces peak detection errors under a wide variety of adverse environments.

As can be seen in FIG. 23 the filtered response has multiple peaks, but the desired peak has twice the amplitude as the nearest undesired peaks. This difference is sufficient to provide a high degree of immunity to false peak detection in the presence of noise. In terms of amplitude, it is twice as immune to noise as the more standard method of detection. In terms of power it is four times more noise immune. The contrast between this method and the more standard method becomes more pronounced in real systems where the bandwidth is limited.

Frequency dependent amplitude and phase distortions arising primarily from the various transducers can cause variations from the ideal response in ways that are difficult to predict and control. For this reason a relatively band-pass filter is included in the receiver. This filter is presumably more narrow-band than the transducers and, therefore, its effects dominate the response.

The filter can be chosen to simultaneously provide multiple functions. Firstly, its bandwidth can be selected to be narrower than the transducers so as to dominate the response. Secondly, it can provide an anti-aliasing function used in relation to a sampled system. Thirdly, its group delay can be chosen such that its output is well demodulated by the modulated matched filter. This third and more subtle requirement translates to the selection of the group delay to be a multiple of a half cycle. In a particular embodiment, a filter with a Q of 1.8 to affect the best combination of the three issues mentioned above is used. A Q of 1.8 provides a group delay of ½ cycle. With the above choices, the peak can be determined well enough to ensure the proper selection of n. The phase of the signal can be used to further refine the position measurement obtained using the modulated matched filter technique.

In a particular embodiment the audio carrier is 5680 Hz with a wavelength of 2.3 inches at sea level. The burst duration is 3.8 ms. The digitizing sample rate is 22727 samples per second. A peak detection error of one sample corresponds to 90 degrees of the audio carrier so n can be determined with a peak detection error of +/−1 samples. In practice, with moderate emission volume, and for distances of less than 10 ft, peak detection errors occur only under extremely noisy conditions. Thus peak detection accuracy is sufficient to determine n. The phase of the signal can be used to refine the measurement to an accuracy of approximately +/−0.1 inches. In this particular embodiment, two different Barker codes can be used in order to transmit a bit of information from the remote device to the base station. There are four possible 7-bit Barker codes:

(a)−+−−+++
(b)+−++−−−
(c)+++−−+−
(d)−−−++−+

Figure 24:
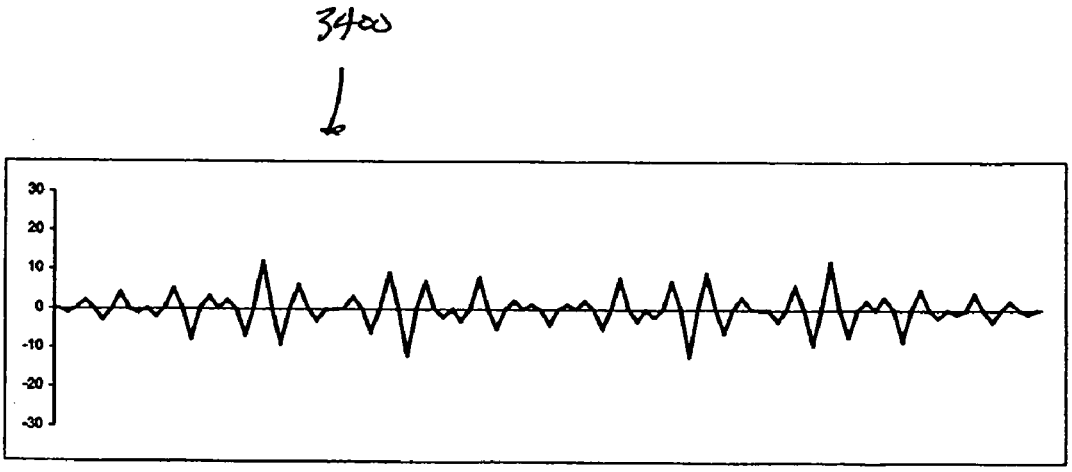

In one embodiment, the codes a) and c) above are used. All four codes give the response through their respective Barker filter as shown in FIG. 20. The code (a) filter gives a poor response to a code (c) input, and vice-versa. The output of the code (a) Barker modulated matched filter in response to a code (c) input is shown in diagram 3400 of FIG. 24. The relatively low output signal allows the two filter outputs to be compared directly in order to resolve which of the two codes was transmitted.

Figure 25:
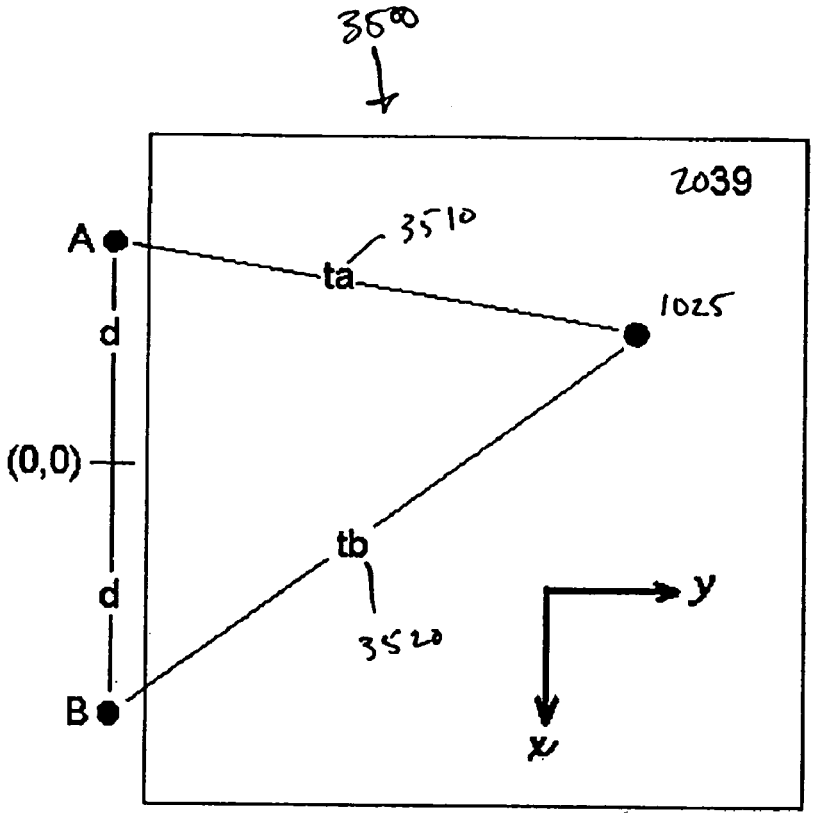

The triangulation geometry is shown in diagram 3500 of FIG. 25. The transit times $t_a$ 3510, $t_b$ 3520, of the emitted signal of remote device 1025 are measured to both microphones 2026*a*, 2026*b*. The distances are then computed using $$l_a=ct_a$$

$$l_b=ct_b$$

Where:

c=speed of sound

The coordinates of the remote device are computed using:

$$x=\frac{l_a^2-l_b^2}{4d}$$

and $$y=\sqrt{l_b^2-(d-x)^2}$$

As the equations show, y cannot be negative, which reflects the fact that this two-microphone geometry may not uniquely distinguish positions where y<0.

Alternatively, interferometry techniques can be used instead of triangulation. In this method multiple microphones are arranged in a pattern of dimensions smaller than a wavelength. The known configuration and the phase relationships between the received signals is used to determine the bearing of the emitter. The time of arrival determines the range. Range and bearing are sufficient to uniquely specify position in two dimensions.

In one embodiment a constellation of three equally spaced microphones forms an equilateral triangle in the plane of the two dimensional surface. Consequently, the spacing between microphones is 150 degrees of a wavelength. The closer the microphones are spaced, the more accurate the bearing approximation below becomes. However, closer spacing also leads to greater sensitivity to noise and phase errors present in the measurements. Wide microphone placement reduces the accuracy of the bearing approximation given below, but reduces the sensitivity to noise and phase errors in the measurement. A 150 degree element spacing can be chosen to result in a reasonable compromise between these two opposing considerations.

The method of the interferometric technique is as follows: a peak detection algorithm determines the time of arrival to one of the microphones. At this time, the value of the received signal from all three microphones is stored. These values are used to compute a unit vector representing the bearing of the received signal. The unit vector is multiplied by the range as determined by the time of arrival to determine the coordinates of the emitter.

Defining the stored complex values of the signals from the three microphones at the time of peak detection as A, B, and C, a bearing vector V is given by the approximate formulas:

$$V_x \approx \frac{1}{\sqrt{3}}(c_q a_i - c_i a_q - b_q c_i + b_i c_q)$$

and $$V_y \approx \frac{1}{3}(2a_q b_i - 2a_i b_q - b_q c_i + b_i c_q - c_q a_i + c_i a_q)$$

Where the convention is chosen $\overline{A}=a_i+ja_q$ and j is $\sqrt{-1}$.

The unit bearing vector U is then:

$$U_x = \frac{V_x}{|\overline{V}|} \text{ and, } U_y = \frac{V_y}{|\overline{V}|}$$

Finally, the position P is computed by multiplying the unit bearing vector U with the range R as:

$$\overline{P}=\overline{U}R$$

The above equations are not exact, and were derived with simplicity in mind so as to be readily applicable to low cost, low performance microprocessors.

Figure 26:
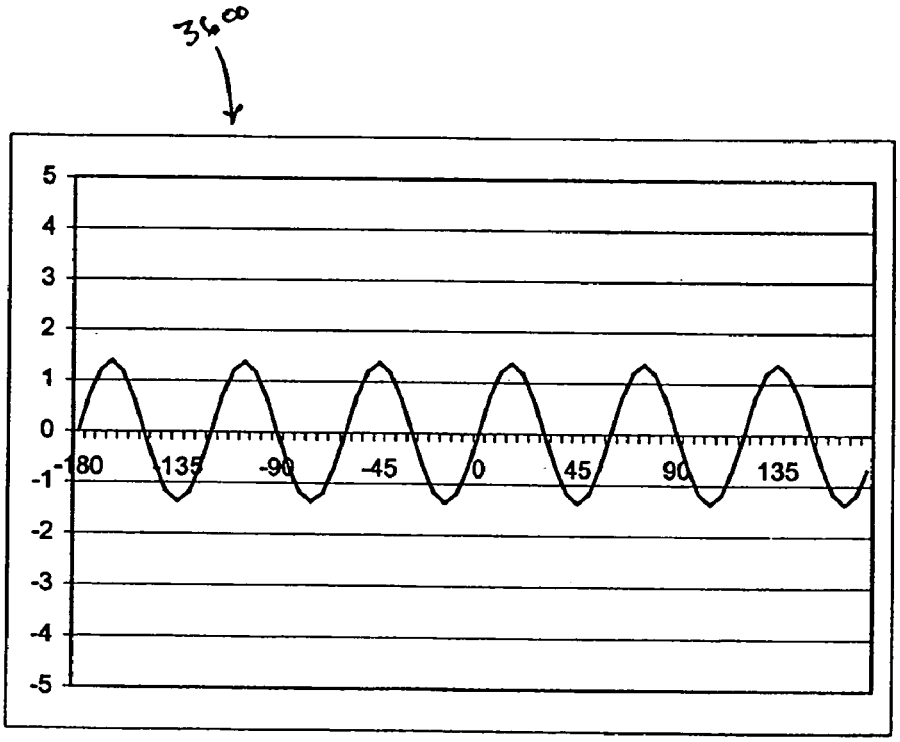

The curve of diagram 3600 of FIG. 26 shows the deviation in degrees of the unit vector U as a function of actual incident angle in degrees. The maximum bearing error is 1.4 degrees corresponding to an error of 2.5 inches at a radius of 10 feet. This error is systematic and can be removed if necessary. However, note that it amounts to a positioning distortion. In applications where only relative positions are important and then only when two devices are relatively close to one another, the effects of this distortion become negligible. In other words, when two devices are in close proximity to one another, this approximation has little effect on the computation of their separation or relative bearing.

The invention has now been described in detail for purposes of clarity and understanding. However, it will be appreciated that certain changes and modifications may be practiced within the scope of the appended claims. Thus, although the invention is described with reference to specific embodiments and figures thereof, the embodiments and figures are merely illustrative, and not limiting of the invention. Rather, the scope of the invention is to be determined solely by the appended claims.

What is claimed is:

1. Electromechanical apparatus, comprising:

an electromechanical device, which is powered by electricity and is turnable and moveable in any direction on a support surface, said electromechanical device having a plurality of electric contacts that are spaced apart in relation to each other in positions to make electric contact with the support surface, said electric contacts being electrically connected to a rectifier circuit that is capable of rectifying electric power from said electric contacts whenever at least one of said electric contacts is at a first voltage level and at least another one of said electric contacts is at a second voltage level;

a contact system having a plurality of pads that comprise at least part of said support surface, wherein some of said pads are at the first voltage level and others of said pads are at the second voltage level, and further wherein the pads at the first voltage level are interspersed with the pads at the second voltage level in such a manner that movement of the electromechanical device in any direction on the support surface can result in a condition in which at least one of the contacts touches at least one pad at the first voltage level while at least one other of the contacts touches at least one pad at the second voltage level.

2. The electromechanical apparatus of claim 1, further including:

a power source coupling, which includes a first lead electrically coupled to some of said pads and a second lead electrically coupled to others of said pads, and wherein the first lead and the second lead are operable for biasing the first voltage level and the second voltage level, respectively; and an insulation region, wherein said some of said plurality of pads are spaced apart from said others of said plurality of pads by the insulation region.

3. The electromechanical apparatus of claim 2, further comprising:

a transformer that supplies a power output based on a power input, and wherein the first voltage level and the second voltage level are derived from the power output.

4. The electromechanical apparatus of claim 3, wherein the power output is an alternating current output.

5. The electromechanical apparatus of claim 2, wherein an upper portion of the support surface comprising the plurality of first pads, the plurality of second pads, and the insulation region is a continuous two-dimensional surface.

6. The electromechanical apparatus of claim 2, wherein the plurality of first pads, the plurality of second pads, and the insulation region are disposed to form a continuous three-dimensional surface.

7. The electromechanical apparatus of claim 2, wherein the plurality of first pads, the plurality of second pads, and the insulation region are disposed to form a discontinuous three-dimensional surface.

8. The electromechanical apparatus of claim 2, wherein the insulation region is part of a non-conductive substrate.

9. The electromechanical apparatus of claim 8, wherein the plurality of pads are disposed on the non-conductive substrate.

10. The electromechanical apparatus of claim 8, wherein the plurality of pads are formed within a plurality of impressions within the non-conductive substrate.

11. The electromechanical apparatus of claim 2, wherein the plurality of first pads, the plurality of second pads, and the insulation region are disposed on a non-conductive substrate.

12. The electromechanical apparatus of claim 2, wherein at least one of the plurality of first pads is biased separate from at least another of the plurality of first pads.

13. The electromechanical apparatus of claim 2, wherein the plurality of pads are formed as a plurality of substantially polygonal pads.

14. The electromechanical apparatus of claim 13, wherein the substantially polygonal pads are substantially rectangular pads.

15. The electromechanical apparatus of claim 2, wherein the plurality of pads and the insulation region are disposed on a non-conductive substrate.

16. The electromechanical apparatus of claim 2, wherein the first and second voltage levels are different.

17. The electromechanical apparatus of claim 1, wherein the plurality of pads at the first voltage level are spaced apart from the plurality of pads at the second voltage level by a distance that is greater than a dimension of the electric contacts of the electromechanical device.

18. The electromechanical apparatus of claim 1, wherein the contact system comprises:

a support surface, wherein the support surface includes a substantially non-conductive substrate, and wherein the plurality of pads are disposed on the substantially non-conductive substrate; and wherein an upper surface that includes the pads at the first voltage level and the pads at the second voltage level is a continuous surface; and a power source coupled to the plurality of pads to bias some of said pads at the first voltage level and others of said pads at the second voltage level.

19. The electromechanical apparatus of claim 18, wherein the power source is a transformer.

20. The electromechanical apparatus of claim 18, wherein the continuous surface is selected from a group consisting of: continuous two-dimensional; and continuous three-dimensional.

21. The electromechanical apparatus of claim 1, wherein:

the support surface includes a substantially non-conductive insulation region;

the plurality of pads are disposed on a substantially non-conductive substrate;

a power source is coupled to the plurality of pads to bias some of said pads at the first voltage level and others of said pads at the second voltage level;

the electromechanical device includes a movement element, a power storage element, and a plurality of couplings; and the plurality of couplings complete a circuit including the power storage element, a first conductive contact between one of the plurality of couplings and one of the plurality of first pads, and a second conductive contact between another of the couplings and one of the plurality of second pads.

22. The electromechanical apparatus of claim 21, wherein the power storage element includes a device selected from a group consisting of: a capacitor and a rechargeable battery.

23. The electromechanical apparatus of claim 21, wherein the movement element is selected from a group consisting of: a leg, a flexible brush, and a wheel.

24. The electromechanical apparatus of claim 21, wherein at least a portion of the substantially non-conductive substrate is formed of a material selected from a group consisting of: plastic, glass, rubber, paper fibers, ceramic, and silicon.

25. The electromechanical apparatus of claim 21, wherein an upper surface that includes the plurality of first pads and the plurality of second pads is continuous, two-dimensional.

26. The electromechanical apparatus of claim 1, including control circuitry associated with the contact system and operable to switch off and on selected ones of the pads to vary operability of the pads.

27. The electromechanical apparatus of claim 1, further including:

a power source coupling, wherein the power source coupling includes a first lead electrically coupled to the pads at the first voltage level and a second lead electrically coupled to the pads at the second voltage level, and wherein the first lead and the second lead are operable for biasing the first voltage level and the second voltage level, respectively; and an insulation region, wherein said some of said plurality of pads are spaced apart from said others of said plurality of pads by an insulation region.

28. A method for providing electric power to an electromechanical device that is moveable to, and positionable at, divers locations on a support surface, comprising:

providing the support surface with a plurality of pads at one voltage level interspersed with a plurality of pads at another voltage level;

providing the electromechanical device with a plurality of electric contacts, at least two of which are spaced apart from each other a sufficient distance to accommodate positioning of one of said contacts to be in electric contract with one of said pads at said one voltage level simultaneously with positioning another of said contacts to be in electric contact with another of said pads at said another voltage level;

rectifying electric current flowing between said contacts to provide electric power for operating said electromechanical device, regardless of which one of said contacts is positioned in electric contact with the pad at said one voltage level and which another of said contacts is positioned in electric contact with the pad at said another voltage level.

29. The method of claim 28, wherein said support surface is substantially non-conductive, further comprising:

forming a conductive material on the substantially non-conductive support surface;

defining a plurality of first pads in the conductive material;

defining a plurality of second pads in the conductive material; and defining an insulation region between the plurality of first pads and the plurality of second pads.

30. The method of claim 29, wherein the method further comprises:

electrically coupling a power source coupling to the plurality of first pads and the plurality of second pads, wherein the power source is operable for biasing the plurality of first pads at a first voltage level, and the plurality of second pads at a second voltage level.

31. The method of claim 29, wherein forming the conductive material on the substantially non-conductive substrate includes forming an adhesive layer between the conductive material and the substantially non-conductive material.

32. A method for providing electric power to an electrically-powered device that is positionable at divers locations on a support surface, comprising:

providing the support surface with a plurality of pads at one voltage level interspersed with a plurality of pads at another voltage level;

providing the electrically-powered device with a plurality of electric contacts, at least two of which are spaced apart from each other a sufficient distance to accommodate positioning of one of said contacts to be in electric contract with one of said pads at said one voltage level simultaneously with positioning another of said contacts to be in electric contact with another of said pads at said another voltage level;

rectifying electric current flowing between said contacts to provide electric power for operating said electrically-powered device, regardless of which one of said contacts is positioned in electric contact with the pad at said one voltage level and which another of said contacts is positioned in electric contact with the pad at said another voltage level.

33. A device which is powered by electricity and is positionable on a support surface, said device having a plurality of electric contacts that are spaced apart in relation to each other in positions to make electric contact with the support surface, said electric contacts of said device being electrically connected to a rectifier circuit in the device that is capable of rectifying electric power from said electric contacts of said device to a specific polarity whenever at least one of said electric contacts of said device is at a first voltage level and at least another one of said electric contacts of said device is at a second voltage level.

34. The device of claim 33, wherein:

said device is powered by electricity at a first polarity;

the support surface has a plurality of support contacts, some of which are at a first voltage level and at least one of which is at a second voltage level; and said rectifier circuit is connected to said electric contacts of the device and configured to provide said electricity at said first polarity whenever at least one of the electric contacts of the device is in contact with at least one of the support contacts at the first voltage level and at least another of the electric contacts of the device is in contact with at least another of the support contacts at the second voltage level, regardless of whether said one and said another of the electric contacts of the device are at the first polarity or at a second polarity that is opposite said first polarity.

35. Electrical apparatus, comprising:

a device, which is powered by electricity and that can be positioned at divers locations on a support surface, said device having a plurality of electric contacts that are spaced apart in relation to each other in positions to make electric contact with the support surface, said electric contacts being electrically connected to a rectifier circuit that is capable of rectifying electric power from said electric contacts whenever at least one of said electric contacts is at a first voltage level and at least another one of said electric contacts is at a second voltage level; and a contact system having a plurality of pads that comprise at least part of said support surface, wherein some of said pads are at the first voltage level and others of said pads are at the second voltage level, and further wherein the pads at the first voltage level are interspersed with the pads at the second voltage level in such a manner that movement of the electromechanical device in any direction on the support surface can result in a condition in which at least one of the contacts touches at least one pad at the first voltage level while at least one other of the contacts touches at least one pad at the second voltage level.

36. Electrical apparatus, comprising:

a device, which is powered by electricity, includes a plurality of electrical contacts for receiving electric power, said device and the electric contacts being configured in a manner that enables the device to be positioned on a support surface with the electrical contacts in electric contact with the support surface, and said device having electric circuitry connected to the electric contacts that enables the device to receive electric power when at least one of said electric contacts is in electrical connection with a power source at a different voltage level than at least another of said electric contacts; and a contact system having a plurality of pads that are comprised in said support surface and that are electrically connected to the power source in such a manner that there is a voltage difference between at least some of said pads that are interspersed with each other in a manner that provides a voltage difference between at least two of the electric contacts of the device when the device is positioned on a part of the support surface which comprises the pads that are electrically connected to the power source.

37. The electrical apparatus of claim 36, wherein said pads are shaped, sized, and interspersed on the support surface in relation to the distribution of the contacts of the device to achieve a desired power transfer probability at the desired positions and orientations of the device on the support surface.

38. The electrical apparatus of claim 37, wherein said pads are arranged in a regular pattern.

39. The electrical apparatus of claim 37, wherein said pads are arranged in a pattern that has rotational symmetry.

40. The electrical apparatus of claim 37, wherein said pads having the voltage difference between them are intermixed on a size scale smaller than a span of the electric contacts of the device.

41. The electrical apparatus of claim 37, wherein said pads are square and arranged in a checkerboard pattern of alternate voltage levels.

42. The electromechanical apparatus of claim 37, wherein said plurality of pads are arranged in a regular pattern.

43. The electromechanical apparatus of claim 37, wherein said plurality of pads are arranged in a pattern that has rotational symmetry.

44. The electromechanical apparatus of claim 37, wherein said plurality of pads having different voltage levels are intermixed on a size scale smaller than a span of the electric contacts of the device.

45. The electromechanical apparatus of claim 37, wherein said plurality of pads are square and arranged in a checkerboard pattern of alternate voltage levels.

46. The electrical apparatus of claim 36, wherein said pads are square and arranged in a two-dimensional matrix, and wherein said pads are connectable to the power source in such a manner that laterally adjacent pads are at different voltages in relation to each other.

47. The electrical apparatus of claim 46, wherein the device has at least five electric contacts.

48. The electrical apparatus of claim 46, wherein the device has at least five electric contacts arranged in a circular pattern.

49. The electrical apparatus of claim 46, wherein the device has at least five electric contacts equally spaced on a circle in a pentagon pattern.

50. The electrical apparatus of claim 49, wherein the circle has a radius that is proportioned in relation to the matrix of square pads such that there is a one hundred percent power transfer probability regardless of orientation of the device positioned on any part of the matrix of pads that are electrically connected to the power source.

51. The electrical apparatus of claim 36, wherein the pads are electrically connected to the power source in a direct current manner.

52. The electrical apparatus of claim 36, wherein the pads are electrically connected to the power source in an alternating current manner.

53. The electrical apparatus of claim 36, wherein the electric circuitry of the device includes a rectifier circuit.

54. The electrical apparatus of claim 53, wherein the device is powered by rectified electric current produced by the rectifier circuit.

55. The electrical apparatus of claim 53, wherein the electric circuitry of the device includes a power storage component that is connected electrically to the rectifier circuit and that is chargeable with rectified current produced by the rectifier circuit.

56. The electrical apparatus of claim 55, wherein the device is powered by electric current from the power storage component.

57. The electrical apparatus of claim 55, wherein the power storage component comprises a capacitor.

58. The electrical apparatus of claim 55, wherein the power storage component comprises a rechargeable battery.

59. The electromechanical apparatus of claim 36, wherein said plurality of pads are square and arranged in a two-dimensional array, and wherein said pads are connectable to the power source so that laterally adjacent pads are at different voltages.

60. The electromechanical apparatus of claim 59, wherein the device has at least five electric contacts.

61. The electromechanical apparatus of claim 59, wherein the device has at least five electric contacts arranged in a circular pattern.

62. The electromechanical apparatus of claim 59, wherein the device has at least five electric contacts equally spaced on a circle in a pentagon pattern.

63. The electromechanical apparatus of claim 62, wherein the circle has a radius that is proportioned in relation to the square pads such that there is a one hundred percent power transfer probability regardless of orientation of the device positioned on any part of the support surface which comprises the pads that are electrically connected to the power source.

64. The electrical apparatus of claim 59, wherein the power source provides the pads with an alternating current.

65. The electrical apparatus of claim 36, wherein the power source provides the pads with a direct current.

66. Electrical apparatus, comprising:

a component that utilizes electric power; and at least five electric contacts for receiving electric power for said component from a support surface which comprises at least two electrically distinct pads that have specific shapes, sizes, and distributions on the support surface separated by gaps and are connected to a power supply in a manner that creates opposite voltage potential polarity between said electrically distinct pads, wherein said at least five electric contacts on the device are distributed in a manner relative to the shapes, sizes, and distributions of the pads such that no more than three of the at least five contacts can be positioned in the gaps between said pads regardless of how the apparatus is positioned on the support surface.

67. The electrical apparatus of claim 66, wherein at least one of the pads is a square and the device has at least five electric contacts equally spaced on a circle.

* * * * *